US006329317B1

(12) United States Patent
Takayama et al.

(10) Patent No.: US 6,329,317 B1
(45) **Date of Patent: *Dec. 11, 2001**

(54) DECOLORING METHOD OF DECOLORIZABLE IMAGE FORMING MATERIAL

(75) Inventors: Satoshi Takayama; Shigeru Machida, both of Kawasaki; Kenji Sano, Tokyo, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/235,332

(22) Filed: Jan. 22, 1999

(30) Foreign Application Priority Data

Jan. 23, 1998 (JP) ..... 10-011681
Jan. 23, 1998 (JP) ..... 10-011682

(51) Int. Cl.[7] ..... B41M 5/128

(52) U.S. Cl. ..... 503/201; 503/205; 503/214

(58) Field of Search ..... 106/31.32; 503/201, 503/205, 214

(56) References Cited

U.S. PATENT DOCUMENTS

| | | | | |
|---|---|---|---|---|
| 4,687,319 | | 8/1987 | Mishra | 355/10 |
| 4,733,272 | | 3/1988 | Howe et al. | 355/10 |
| 5,130,290 | * | 7/1992 | Tanimoto | 503/201 |
| 5,545,381 | | 8/1996 | Iida et al. | 422/186 |
| 5,612,766 | | 3/1997 | Iida et al. | 399/23 |
| 5,642,550 | | 7/1997 | Maruyama et al. | 15/102 |
| 5,663,115 | | 9/1997 | Naito et al. | 503/201 |
| 5,766,462 | | 6/1998 | Jones | 210/232 |
| 5,849,651 | | 12/1998 | Takayama et al. | 503/201 |
| 6,017,386 | | 1/2000 | Sano et al. | 106/31.32 |

FOREIGN PATENT DOCUMENTS 32 47 804 7/1983 (DE) .

OTHER PUBLICATIONS

Patent Abstracts of Japan, vol. 97, No. 010, Oct. 31, 1997, JP 9–165537, Jun. 24, 1997.

Patent Abstracts of Japan, vol. 008, No. 062 (C–215), Mar. 23, 1984, JP 58–217566, Dec. 17, 1983.

Patent Abstracts of Japan, vol. 007, No. 109 (P–196), May 12, 1983, JP 58–030765, Feb. 23, 1983.

Derwent Abstract, AN 97–388955, JP 9–169162, Jun. 30, 1997.

Derwent Abstract, AN 95–158568, JP 7–081236, Mar. 28, 1995.

Derwent Abstract, AN 92–069822, JP 4–014482, Jan. 20, 1992.

* cited by examiner

*Primary Examiner*—Bruce H. Hess
(74) *Attorney, Agent, or Firm*—Oblon, Spivak, McClelland, Maier & Neustadt, P.C.

(57) ABSTRACT

A method of decoloring an image formed on a paper sheet by using an image forming material containing a color former, a developer and a decolorizer, comprising the steps of bringing a solvent into contact with the image forming material for decoloring the image, and removing the residual solvent from the paper sheet.

26 Claims, 5 Drawing Sheets

DECOLORING METHOD OF DECOLORIZABLE IMAGE FORMING MATERIAL

BACKGROUND OF THE INVENTION

The present invention relates to a method of decoloring a decolorizable image forming material.

In recent years, the amount of various kinds of information has significantly increased by spread of office automation, and so the level of information output has also increased. The information output is represented by display output and hard copy output from a printer onto paper sheets. The display output, however, requires a large scale circuit board in a display unit. This brings about problems of portability and cost. Regarding the hard copy output, a large quantity of paper as a recording medium is being consumed with increase in the information output amount. Therefore, the hard copy output is expected to be a problem with respect to conservation of natural resources. In addition, recycling of paper sheets once printed by a printer or a copying machine is expensive, since much of a bleaching agent and water are required for the recycling and consumption of electric power is enormous. Under such a situation, it is considered to decrease consumption of paper substantially by using decolorizable image forming material to print information on a paper sheet, restoring a blank sheet of paper by decoloring the formed image, and reusing the paper sheet.

Heretofore, ink which can be decolored on heating has been proposed in, for example, Published Unexamined Japanese Patent Application No. 7-81236. The ink includes a color former such as a leuco dye, a developer, and a organophosphoric compound having a decoloring power.

When such image forming material is used, however, decoloring can be done insufficiently and, as a result, a paper sheet is hard to return to the blank state. For this reason, decolorizable image forming material cannot have been put into practical use.

Under such a situation, the present inventors have proceeded with development of a new image forming material and an image decoloring method. However, we have been found that it is not always easy to decolor various image forming materials prepared by combining various components with a high decoloring rate and to maintain a good decolored state.

BRIEF SUMMARY OF THE INVENTION

An object of the present invention to provide a method of decoloring an image forming material at a high decoloring rate by which stable decolored state can be maintained.

According to an aspect of the present invention, there is provided a method of decoloring an image formed on a paper sheet by using an image forming material containing a color former, a developer and a decolorizer, comprising the steps of: bringing a solvent into contact with the image forming material for decoloring the image; and removing the residual solvent from the paper sheet.

According to another aspect of the present invention, there is provided a method of decoloring an image formed on a paper sheet by using an image forming material containing a color former and a developer, comprising the steps of: bringing a solvent containing a decolorizer into contact with the image forming material for decoloring the image; and removing the residual solvent from the paper sheet.

With the present invention, an image can: be decolored at a high decoloring rate as well as a good decolored state can be maintained by properly selecting an decolorizer and a solvent depending on the image forming material.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
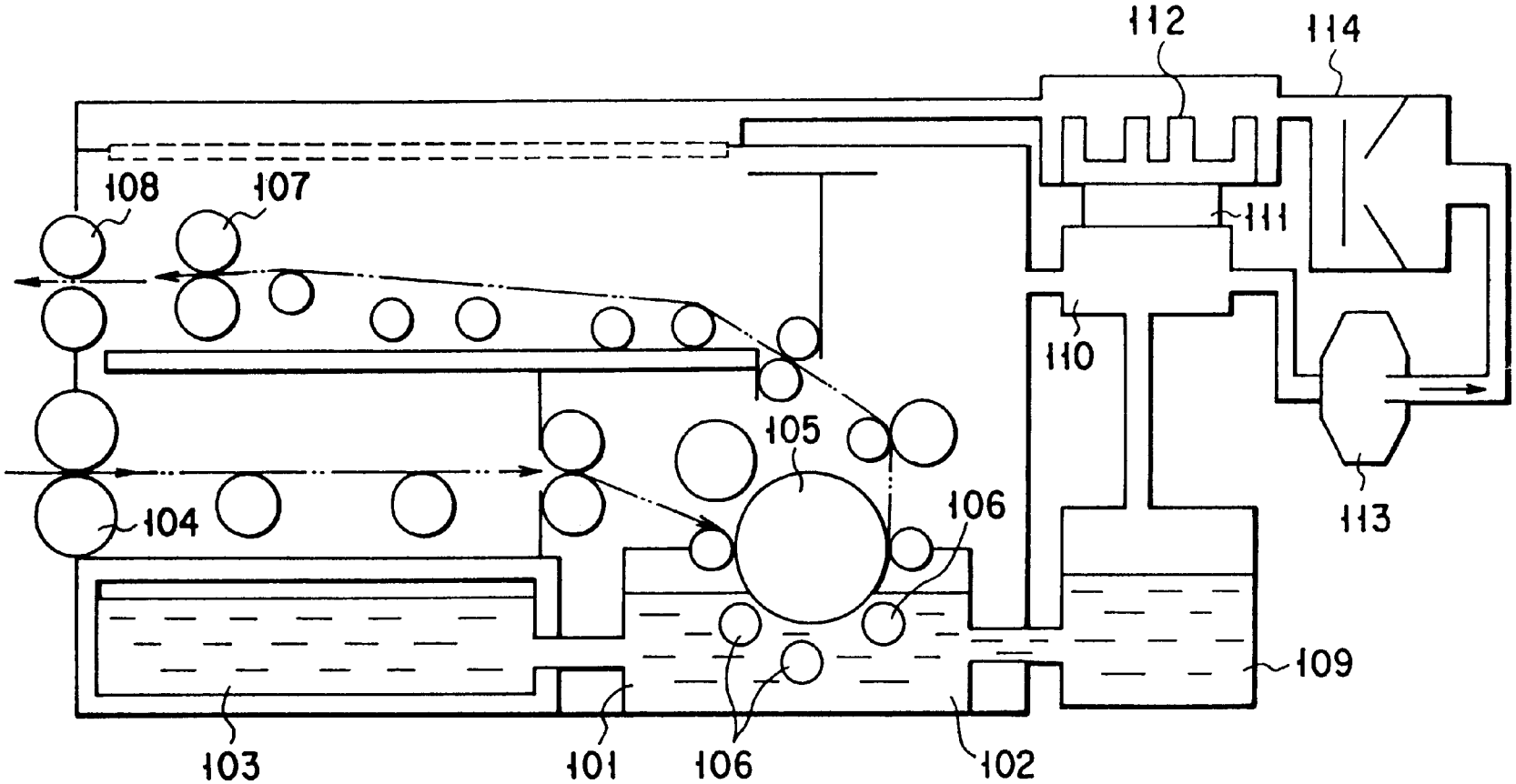
FIG. 1 shows an image decoloring apparatus using a solvent according to the present invention.

The present invention will be described in detail below.

The image forming material of the present invention uses a color former and a developer in combination with a decolorizer to enable image-forming and decoloring. First, functions of basic components used in the image forming material of the present invention will be described. A color former is a precursor compound of a coloring matter which forms colored information such as characters and graphics, a developer is a compound which develops a color former by the interaction (primarily, exchange of an electron or proton) between the developer and the color former, and a decolorizer is a compound represents preferential compatibility with one of the color former and the developer.

When the composition system of the image forming material comprising these components is in a solidified state, it is possible for the system to assume one of the following two particular states:

(1) A colored state in which the decolorizer is mixed with the color former and the developer in an amount that corresponds to the equilibrium solubility, and the excessive color former and developer over the equilibrium solubility are phase-separated from the decolorizer, with the result that the interaction between the color former and the developer is increased to develop a color.

(2) A decolored state in which the decolorizer dissolves a larger amount of the color former and the developer than the equilibrium solubility, with the result that the interaction between the color former and the developer is decreased to lose the color.

Changes between colored and decolored states are effected in accordance with a principle described below.

Here, a case where the image forming material is decolored by heating is described for the sake of convenience. It is assumed in the following description that, when the image forming material is melted into a fluidized condition, the decolorizer preferentially dissolves the developer. At room temperature, a condition in which a phase of the color former and the developer is separated from a phase of the decolorizer is close to equilibrium. In this condition, the system is in a colored state, since the color former and the developer interact with each other. When the composition system in the colored state is heated up to the melting point or higher to be a fluidized condition, the developer is preferentially dissolved into the decolorizer. As a result, the interaction between the developer and the color former is lost, leading to a decolored state. When the composition system is forcedly solidified by cooling rapidly from the molten state, the decolorizer takes the developer into itself in a large amount exceeding the equilibrium solubility. As a result, the system is turned amorphous and colorless at room temperature. Although the amorphous composition system is under a non-equilibrium state in a relative sense, the amorphous system exhibits a sufficiently long life at temperatures not higher than a glass transition point Tg. Therefore, if Tg is not lower than room temperature, the system does not easily converted from the amorphous state to the equilibrium state.

In the present invention, an image forming material comprising a color former, a developer and a decolorizer is brought into contact with a solvent. In such a method in which the image forming material is brought into contact with a solvent, decoloring is also performed according to the following principle, as is the case of decoloring the image forming material by heating. It is assumed in the following description that the image forming material contains a binder. When the image forming material in a color developed state is brought into contact with a solvent, the binder is swelled or partly resolved in the solvent. As a result, the developer and decolorizer are in a state that they can move relatively free. Therefore, the developer is mixed with the decolorizer, and the developer loses interaction with the color former and, thus, the image forming material is decolored. When the solvent is removed, the decolorizer takes in the developer in an amount exceeding an equilibrium solubility to become amorphous, so that the decolored state of the image forming material is fixed. This decolored state is very stable at room temperature.

In the present invention, an image may be decolored by the method in which an image forming material is brought into contact with a solvent containing a decolorizer. In this case, a high decoloring rate can be realized by selecting a suitable decolorizer depending on the image forming material. This method is particularly advantageous when a lot of paper sheets containing various image forming materials are subjected decoloring treatment.

If the image is decolored by using a solvent, quality of the paper sheet after decoloration is improved. The reason is as follows. That is, when the image forming material is decolored by being brought into contact with a solvent and then the solvent which has been contained in the binder is evaporated, the binder is made porous. Since light is scattered on the surface of the porous binder, reflection on the binder is diminished. In addition, the binder and the other components are spread out widely, so that the boundary between portions where the image forming material is present and is not present becomes unclear. Therefore, the remaining image forming material is hardly recognized either by eye or hand.

Next, compounds used as components of the image forming material of the present invention are described below.

The color former used in the present invention includes electron-donating organic substances such as leucoauramines, diarylphtalides, polyarylcarbinoles, acylauramines, arylauramines, Rohdamine B lactams, indolines, spiropyrans and fluorans.

To be more specific, the color former includes Crystal Violet lactone (CVL), Malakite Green lactone, 2-anilino-6-(N-cyclohexyl-N-methylamino)-3-methylfluoran, 2-anilino-3-methyl-6-(N-methyl-N-propyl-amino)fluoran, 3-[4-(4-phenylaminophenyl)aminophenyl]-amino-6-methyl-7-chlorofluoran, 2-anilino-6-(N-methyl-N-isobutylamino)-3-methylfluoran, 2-anilino-6-(dibutyl-amino)-3-methylfluoran, 3-chloro-6-(cyclohexylamino)-fluoran, 2-chloro-6-(diethylamino)fluoran, 7-(N,N-diethylamino)-3-(N,N-diethylamino)fluoran, 3,6-bis(diethylamino)fluoran, γ-(4'-nitroanilino)lactam, 3-diethylaminobenzo[a]-fluoran, 3-dietylamino-6-methyl-7-aminofluoran, 3-diethylamino-7-xylidino-fluoran, 3-(4-diethylamino-2-ethoxyphenyl)-3-(1-ethyl-2-methylindole-3-yl)-4-azaphthalide, 3-(4-diethylaminophenyl)-3-(1-ethyl-2-methylindole-3-yl) phthalide, 3-diethylamino-7-chloroanilinofluoran, 3-diethylamino-7,8-benzofluoran, 3,3-bis(1-n-butyl-2-methylindole-3-yl)phthalide, 3,6-dimethylethoxyfluoran, 3,6-diethylamino-6-methoxy-7-aminofluoran, DEPM, ATP, ETAC, 2-(2-chloroanilino)-6-dibutylaminofluoran, Crystal Violet carbinol, Malachite Green carbinol, N-(2,3-dichlorophenyl)leucoauramine, N-benzoylauramine, Rhodamine B lactam, N-acetylauramine, N-phenylauramine, 2-(phenyliminoethanedilydene)-3,3-dimethylindoline, N,3,3-trimethylindolinobenzospiropyran, 8'-methoxy-N,3,3-trimethylindolinobenzospiropyran, 3-diethyl-amino-6-methyl-7-chlorofluoran, 3-diethylamino-7-methoxyfluoran, 3-diethyamino-6-benzyloxyfluoran, 1,2-benzo-6-diethyaminofluoran, 3,6-di-p-toluidino-4,5-dimetylfluoran, phenylhydrazide-γ-lactam, and 3-amino-5-methylfluoran. The color former compounds exemplified above can be used singly or in a combination of two or more species. If color formers are selected properly, a variety of colored states can be obtained, and thus formation of multicolor image can be attained.

The developer used in the present invention includes acidic compounds, such as phenols, metal phenolates, metal carboxylates, benzophenones, sulfonic acids, sulfonates, phosphoric acids, metal phosphates, acidic phosphoric esters, acidic phosphoric ester metal salts, phosphrous acids, and metal phosphites. The developer compounds can be used singly or in a combination of two or more species.

The decolorizer used in the present invention should desirably have a good colorlessness in an amorphous state. If the decolorizer is more colorless and transparent in the amorphous state, a paper sheet is turned white closer to the original paper sheet when the image forming material on the paper sheet is decolored. The decolorizer shows such characteristics should preferably have a high molecular weight and a small enthalpy change of melting ΔH of the crystal per weight and, thus, should be low in maximum crystallization velocity (MCV). If the crystal of decolorizer has a small enthalpy change of melting ΔH, the heat energy required for melting the crystal is decreased, which is desirable in regard to energy saving. In order to increase solubility of the developer in the decolorizer, it is desirable that the decolorizer has a high affinity with the developer. Therefore, the decolorizer should desirably be a compound having, for example, an alcoholic hydroxyl group. From a view point of a storage stability of the composition system in a decolored state, a glass transition point Tg of the composition system should be not lower than room temperature (25° C.), and preferably be not lower than 50° C. In order to satisfy the above condition, the glass transition point Tg of the decolorizer should also be not lower than room temperature (25° C.), and preferably be not lower than 50° C. On the other hand, the crystallization temperature of a decolorizer is in the range of the glass transition point Tg to the melting point Tm of the composition system. Therefore, in order to accelerate decoloring, the glass transition point Tg of a decolorizer should preferably be not higher than 150° C.

As a preferable decolorizer that satisfies above conditions, the following compounds classified in the groups (a) to (c) are enumerated.

(a) Sterol compounds: Specific examples are cholesterol, stigmasterol, pregnenolone, methylandrostenediol, estradiol benzoate, epiandrostene, stenolone, β-sitosterol, pregnenolone acetate, β-chorestanol, 5,16-pregnadiene-3β-ol-20-one, 5α-pregnen-3β-ol-20-one, 5-pregnen-3β,17-diol-20-one 21-acetate, 5-pregnen-3β,17-diol-20-one 17-acetate, 5-pregnen-3β,21-diol-20-one 21-acetate, 5-pregnen-3β,17-diol diacetate, rockogenin, thigogenin, esmiragenin, heckogenin, diosgenin and their derivatives. These decolorizers can be used singly or in a combination of two or more species. Particularly preferable decolorizer which can give a stable decolored state includes methylandrostenediol, heckogenin, rockogenin, thigogenin, diosgenin and esmiragenin.

When a composition system containing the decolorizer selected from the above group in an amorphous state is heated to a temperature higher than a glass transition point, a diffusion velocity of a developer is rapidly increased and a motion of phase separation between the developer and the decolorizer is accelerated in a direction of returning to a equilibrium. If the composition system heated to a temperature higher than the crystallizing temperature and lower than the melting point is then slowly cooled down to room temperature, the system reaches to a stable phase separated state closer to a equilibrium, at which the system returns to a colored state. Therefore, the composition system including the decolorizer of the (a) group can repeat reversible changes between colored and decolored states. In this sense, the decolorizer classified in the (a) group is sometimes referred to, hereinafter, as a "reversible decolorizer". A rewritable recording medium which utilizes such reversible changes has been proposed. However, the present invention has an object to provide decolorizable image forming material whose color is removed after printed, and therefore the reversibility between colored and decolored states is not substantially required in the present invention with the exception of some special applications.

(b) Cholic acid, lithocholic acid, testosterone, cortisone and their derivatives: Specific examples are cholic acid, methyl cholate, sodium cholate, lithocholic acid, methyl lithocholate, sodium lithocholate, hydroxycholic acid, methyl hydroxycholate, hyodeoxycholic acid, methyl hyodeoxycholate, testosterone, methyltestosterone, 11α-hydroxymethyltestosterone, hydrocortisone, cholesterol methyl carbonate, and a-cholestanol. Among them, compounds having two or more hydroxyl groups are especially preferred.

The decolorizer of the (b) group, compared to that of the (a) group, has a stronger affinity to the developer when they are melted, in other words, has a very high compatibility thereto. In addition, the decolorizer of the (b) group has a higher inclination of being amorphous, and therefore a phase separation is hard to occur even after the composition system is solidified. In this sense, the decolorizer classified in the (b) group is sometimes referred to as a "compatible decolorizer" hereinafter. For this reason, the composition system including the decolorizer of the (b) group can maintain a stabler decolored state.

(c) Non-aromatic cyclic compounds of a five-membered or larger ring having one or more hydroxyl groups: The decolorizer of the (c) group should have a melting point of 50° C. or higher. Specific examples are alicyclic monohydric alcohols such as cyclododecanol; alicyclic dihydric alcohols such as 1,4-cyclohexandiol, 1,2-cyclohexandiol and 1,2-cyclododecandiol; saccharides and their derivatives such as glucose and saccharose; alcohols having a ring structure such as 1,2:5,6-diisopropylidene-D-mannitol.

The decolorizer of the (c) group functions effectively when it is used together with the decolorizer of the (a) group, although it may be used singly. That is, the decolorizer of the (c) group has a strong affinity with the decolorizer of the (a) group, and therefore a phase separation is hard to occur even after the system is solidified. In this sense, the decolorizer of the (c) group is sometimes referred to as a "phase separation inhibiting decolorizer" or "phase separation inhibitor" hereinafter. The system including the decolorizer of the (c) group can also maintain a stabler decolored state.

The decolorizer of the (c) group, i.e., the phase separation inhibitor, can be further classified into two types:

(c1) A type having a relatively high melting point and a relatively high glass transition point and, thus, likely to become amorphous at room temperature. Typical examples of the decolorizer of the (c1) type are saccharides and their derivatives. The decolorizer of this type is hereinafter referred to as a highly amorphous phase separation inhibitor.

(c2) A type having a relatively low melting point and a relatively low glass transition point and, thus, unlikely to become amorphous at room temperature with possibility to form microcrystals, but having high compatibility with the developer under a fluidized state. Typical examples of the decolorizer of the (c2) type are alicyclic alcohols. The decolorizer of this type is hereinafter referred to as a slightly amorphous phase separation inhibitor.

Cyclic sugar alcohols can be used in the present invention as a suitable highly amorphous phase separation inhibitor. The specific compounds of the cyclic sugar alcohols used in the present invention include, for example, D-glucose, D-mannose, D-galactose, D-fructose, L-sorbose, L-rhamnose, L-fucose, D-ribodesose, α-D-glucose pentaacetate, acetoglucose, diacetone-D-glucose, D-glucuronic acid, D-galacturonic acid, D-glucosamie, D-fructosamine, D-isosaccharic acid, vitamin C, erutorubic acid, trehalose, saccharose, maltose, cellobiose, gentiobiose, lactose, melibiose, raffinose, gentianose, melizitose, stachyose, methyl α-glucopyranoside, salicin, amygdalin, and euxanthic acid. These compounds can be used singly or in the form of a mixture of at least two compounds.

The slightly amorphous phase separation inhibitor adapted for use in the present invention includes, for example, non-aromatic cyclic compounds other than cyclic sugar alcohols, said non-aromatic cyclic compounds having a five-membered or larger ring and having a hydroxyl group, and derivatives of cyclic sugar alcohols, the typical examples being terpene alcohols. To be more specific, the slightly amorphous phase separation inhibitor used in the present invention includes, for example, alicyclic monohydric alcohols such as cyclododecanol, hexahydrosalicylic acid, menthol, isomenthol, neomenthol, neoisomenthol, carbomenthol, α-carbomenthol, piperithol, α-terpineol, β-terpineol, γ-terpineol, 1-p-menthene-4-ol, isopulegol, dihydrocarveol and carveol; alicyclic polyhydric alcohols such as 1,4-cyclohexanediol, 1,2-cyclohexanediol, phloroglucitol, quercitol, inositol, 1,2-cyclododecane diol, quinic acid, 1,4-terpene, 1,8-terpene, pinol hydrate, and betulin; polycyclic alcohol derivatives such as borneol, isoborneol, adamantanol, fenchol, camphor, and isosorbide; and derivatives of cyclic sugar alcohols such as 1,2:5,6-diisopropylidene-D-mannitol. Further, it is possible to use materials of a molecular structure having a large steric hindrance, which is obtained by the reaction between the cyclic alcohols exemplified above and another compound having a cyclic molecular structure. In the case of using the particular material, it is possible to improve the temperature stability of the image forming material under a decolored state. For example, the ester between isosorbide and cyclohexane dicarboxylic acid can be used as a suitable material of the slightly amorphous phase separation inhibitor. The compounds exemplified above can be used singly or in the form of a mixture of at least two compounds.

Preferable mixing ratio of the color former, the developer and the decolorizer in the image forming material of the present invention is as follows. It is desirable to use the developer in an amount of 0.1 to 10 parts by weight, preferably 1 to 2 parts by weight, relative to 1 part by weight of the color former. If the amount of the developer is smaller than 0.1 parts by weight, coloring of the image forming material by the interaction between the color former and the developer becomes insufficient. If the amount of the developer exceeds 10 parts by weight, it becomes difficult to decrease sufficiently the interaction between these compounds. It is desirable to use the decolorizer in an amount of 1 to 200 parts by weight, preferably 10 to 100 parts by weight, relative to 1 part by weight of the color former. If the amount of the decolorizer is smaller than 1 part by weight, changes between the colored and decolored states cannot occur easily. If the amount of decolorizer exceeds 200 parts by weight, coloring of the image forming material becomes insufficient.

The image e forming material of the present invention can be used various form. For example, it can be used as ink for thermal printer; ink for an ink-jet printer; a toner for plain paper copier (PPC) and laser beam printer, etc.; printing ink for screen printing and typographic printing; ink for writing implements such as ball-point pens and fountain pens. The ink for thermal printer comprises a color former, a developer, a decolorizer and wax, and is applied to a plastic sheet. The ink for an ink-jet printer comprises a color former, a developer and a decolorizer, which are dispersed in a solvent. The toner is prepared by pulverizing a composition containing a color former, a developer, a decolorizer and a binder. In this case, typical binders are polystyrene, styrene acrylate copolymer, polyester and epoxy resin. It should be noted that the decolorizer is added if desired in any use above described.

In the image forming material containing a binder, it is desirable to control appropriately the binder content of the image forming material in accordance with the average molecular weight of the binder. This is because, in the case where an image is decolored by using a solvent, the affinity between the solvent and the binder is decreased with increase in the average molecular weight of the binder.

Where polystyrene is used as a binder, it is desirable to control the binder content depending on the average molecular weight of the binder as follows:

| Average molecular weight | Binder content |
|---|---|
| 1,000 to 200,000 | 30 to 90% by weight. |
| 200,000 to 600,000 | 30 to 80% by weight. |
| 600,000 to 1,000,000 | 30 to 70% by weight. |

The acrylate monomers constituting the styrene-acrylate copolymer include, for example, n-butyl methacrylate, isobutyl methacrylate, ethyl acrylate, n-butyl acrylate, methyl methacrylate, glycidyl methacrylate, dimethylaminoethyl methacrylate, diethylaminoethyl methacrylate, diethylaminopropyl acrylate, 2-ethylhexyl acrylate, butylacrylate-N-(ethoxymethyl)acrylamide, ethyleneglycol methacrylate, and 4-hexafluorobutyl methacrylate. These acrylate monomers can be used singly or in the form of a mixture of at least monomers. It is also possible to use, for example, butadiene, maleic ester, chloroprene, etc., in addition to styrene and acrylate monomer for the polymerization. In this case, it is desirable to set the amount of the additive component such as butadiene at 10% by weight or less. It is also desirable for the binder polymer to contain the styrene in an amount of 50% by weight or more. Where styrene-acrylate copolymer is used as a binder, it is desirable to control the binder content of the image forming material depending on the average molecular weight of the binder polymer as follows:

| Average molecular weight | Binder content |
|---|---|
| 1,000 to 200,000 | 30 to 95% by weight. |
| 200,000 to 400,000 | 30 to 85% by weight. |
| 400,000 to 1,000,000 | 30 to 75% by weight. |

A blend polymer consisting of polystyrene and acrylic resin can also be used as a binder. In this case, it is possible for the blend polymer to contain a single or a plurality of acrylic resins. It is also possible to use a copolymer containing at most 10% by weight of butadiene, maleic ester, chloroprene, etc. The polystyrene content of the binder is desirably 50% by weight or more. Where a blend polymer consisting of polystyrene and acrylic resin is used as a binder, it is desirable to control the binder content of the image forming material depending on the average molecular weight of the polymer as follows:

| Average molecular weight | Binder content |
|---|---|
| 1,000 to 200,000 | 30 to 95% by weight. |
| 200,000 to 400,000 | 30 to 85% by weight. |
| 400,000 to 1,000,000 | 30 to 75% by weight. |

The carboxylic acids and the polyhydric alcohols used as starting materials of the polyester are not particularly limited. For example, the carboxylic acids include terephthalic acid, fumaric acid, maleic acid, succinic acid, glutaric acid, adipic acid, pimelic acid, suberic acid, azelaic acid, sebacic acid, brasylic acid, pyromellitic acid, citraconic acid, glutaconic acid, mesaconic acid, itaconic acid, teraconic acid, phthalic acid, isophthalic acid, hemimellitic acid, mellophanic acid, trimesic acid, prehnitic acid, and trimellitic acid. These carboxylic acids can be used singly or in the form of a mixture of at least two of these compounds. The polyhydric alcohols used in the present invention include, for example, bisphenol A, hydrogenated bisphenol A, ethylene glycol, propylene glycol, butanediol, neopentyldiol, hexamethylenediol, heptanediol, octanediol, pentaglycerol, pentaerythritol, cyclohexanediol, cyclopentanediol, pinacol, glycerin, etherified diphenol, catechol, resorcinol, pyrogallol, benzenetriol, phloroglucinol, and benzenetetraol. These polyhydric alcohols can be used singly or in the form of a mixture of at least two compounds. It is also possible to use a blend polymer consisting of at least two polyesters. Where the polyester is used as a binder of a toner, it is desirable to control the binder content of the image forming material in accordance with the average molecular weight of the polyester as follows:

| Average molecular weight | Binder content |
|---|---|
| 1,000 to 5,000 | 30 to 95% by weight. |
| 5,000 to 10,000 | 30 to 90% by weight. |
| 10,000 to 20,000 | 30 to 87% by weight. |
| 20,000 to 100,000 | 30 to 85% by weight. |
| 100,000 to 1,000,000 | 30 to 80% by weight. |

Where polyester is used as a binder of a thermal transfer ink, paraffin is used as a wax component.

Therefore, it is desirable for the polyester content to fall within a range of between 2 to 50% by weight.

Epoxy resin is synthesized by using as raw materials epichlorohydrin and a compound having a polyhydric phenolic hydroxyl group. The polyhydric phenolic compounds used in the present invention include, for example, bisphenol A, hydrogenated bisphenol A, bisphenol S, etherified diphenyl, catechol, resorcin, pyrogallol, benzenetriol, phloroglucinol, and benzenetetraol. These compounds can be used singly or in the form of a mixture of at least two compounds. Also, it is possible to add 15% by weight or less of phenolic resin, urea resin, melamine resin, alkyd resin, acrylic resin, polyester, polyamide or polyurethane to the epoxy resin. Where an epoxy resin is used as a binder of a toner, it is desirable to control the resin content in accordance with the average molecular weight of the resin as follows:

| Average molecular weight | Binder content |
|---|---|
| 1,000 to 5,000 | 30 to 95% by weight. |
| 5,000 to 10,000 | 30 to 90% by weight. |
| 10,000 to 20,000 | 30 to 87% by weight. |
| 20,000 to 100,000 | 30 to 85% by weight. |
| 100,000 to 1,000,000 | 30 to 80% by weight. |

Where the epoxy resin is used as a binder of a thermal transfer ink, paraffin is used as a wax component. Therefore, it is desirable for the polyester content to fall within a range of between 2 and 50% by weight.

It is desirable for the solvent used in the method in which an image forming material is brought into contact with the solvent to satisfy requirements A and B given below:

A. The solvent should desirably be effective for assisting the formation of hydrogen bond between the developer and the decolorizer.

B. The solvent should desirably exhibit a high affinity with the binder so as to permeate deep inside the image forming material.

The solvent satisfying requirement A given above can be used singly. Also, it is possible to use a plurality of solvents in combination to allow the mixed solvents to satisfy requirements A and B.

The solvents satisfying both requirements A and B (the first group) include, for example, ethers, ketones and esters. To be more specific, the solvents satisfying requirements A and B include, for example, saturated ethers such as ethyl ether, ethyl propyl ether, ethyl isopropyl ether, isopentyl methyl ether, butyl ethyl ether, dipropyl ether, diisopropyl ether, ethyl isopropyl ether, dibutyl ether, dipentyl ether, diisopentyl ether, and dihexyl ether; unsaturated ethers such as ethyl vinyl ether, aryl ethyl ether, diaryl ether, and ethyl propargyl ether; ethers of dihydric alcohols such as ethyleneglycol monomethyl ether, ethyleneglycol monoethyl ether, ethyleneglycol monobutyl ether, ethyleneglycol dimethyl ether, and ethyleneglycol diethyl ether; cyclic ethers such as oxetane, tetrahydrofuran, tetrahydropyran, dioxolane, dioxane, and trioxane; saturated ketones such as acetone, methyl ethyl ketone, methyl propyl ketone, isopropyl methyl ketone, butyl methyl ketone, ethyl propyl ketone, isobutyl methyl ketone, pinacolone, methyl pentyl ketone, butyl ethyl ketone, dipropyl ketone, diisopropyl ketone, hexyl methyl ketone, isohexyl methyl ketone, heptyl methyl ketone, and dibutyl ketone; unsaturated ketones such as ethylidene acetone, allyl acetone, and mesityl oxide; cyclic kotones such as cyclopentanone, cyclohexanone, and cyclooctanone; and esters such as ethyl formate, propyl formate, butyl formate, isobutyl formate, pentyl formate, isopentyl formate, ethyl acetate, isopropyl acetate, propyl acetate, butyl acetate, isobutyl acetate, pentyl acetate, isopentyl acetate, sec-amyl acetate, hexyl acetate, allyl acetate, 2-methoxyethyl acetate, 2-ethoxyethyl acetate, 1,2-diacetoxy ethane, methyl propionate, ethyl propionate, propyl propionate, isopropyl propionate, butyl propionate, pentyl propionate, isopentyl propionate, sec-amyl propionate, 2-methoxypropyl acetate, 2-ethoxypropyl acetate, methyl butyrate, ethyl butyrate, propyl butyrate, isopropyl butyrate, butyl butyrate, pentyl butyrate, isopentyl butyrate, sec-amyl butyrate, methyl isobutyrate, ethyl isobutyrate, propyl isobutyrate, isopropyl isobutyrate, butyl isobutyrate, pentyl isobutyrate, isopentyl isobutyrate, sec-amyl isobutyrate, methyl valerate, ethyl valerate, propyl valerate, isopropyl valerate, butyl valerate, methyl hexanoate, ethyl hexanoate, propyl hexanoate, isopropyl hexanoate and ethyl lactate. Additional solvents used in the present invention include, for example, methylene chloride, γ-butyrolactone, β-propyolactone, N-methylpyrrolidinone, dimethyl formamide, dimethyl acetoamide and dimethyl sulfoxide. These solvents can be used singly or in the form of a mixture of at least two compounds. In the case of using mixed solvents, the mixing ratio can be determined arbitrarily.

The solvents satisfying requirement A, though the affinity with the binder is low (the second group), include, for example, water, methyl alcohol, ethyl alcohol, propyl alcohol, isopropyl alcohol, butyl alcohol, isobutyl alcohol, pentyl alcohol, 2-pentyl alcohol, 3-pentyl alcohol, isopentyl alcohol, 1-hexanol, 2-hexanol, 3-hexanol, cyclopentanol, cyclohexanol, ethylene glycol, propylene glycol, butylene glycol, and glycerin.

On the other hand, the solvents having a high affinity with the binder but failing to satisfy requirement A (the third group) include, for example, toluene, ethylbenzene, propylbenzene, cumene, butylbenzene, isobutylbenzene, sec-butylbenzene, pentylbenzene, diethylbenzene, mesitylene, xylene, cresol, dimethoxybenzene, dimethoxytoluene, benzyl alcohol, tolyl carbinol, cumyl alcohol, acetophenone, propiophenone, hexane, pentane, heptane, octane, cyclohexane, cyclopentane, cycloheptane, cyclooctane, and petroleum fractions such as petroleum ether and benzene.

The first group of the solvents given above can be used singly satisfactorily. The second group of the solvents, which can certainly be used singly, should desirably be mixed with the first group of the solvents. Since each of these first and second groups of the solvents exhibits a decoloring capability, these solvents can be mixed at an arbitrary mixing ratio. Where a solvent of the second group is mixed with a solvent of the third group, the mixing ratio is not particularly limited as far as the mixed solvents exhibit a sufficient decoloring capability. However, it is desirable for the mixing amount of the third group solvent to fall within a range of between 20 and 80% by weight. It is also possible to use the third group solvent together with the first group solvent. In this case, the mixing amount of the third group solvent should be 90% by weight or less. Further, it is possible to use the first, second and third group solvents together. In this case, it is desirable for the mixing amount of the third group solvent to be 80% by weight or less.

For efficiently decoloring the image forming material, it is desirable to heat in advance the solvent. In this case, the solvent temperature should desirably fall within a range of between 40° C. and 150° C.

Where polyester or epoxy resin is used as a binder, the unreacted carboxylic acid or phenol remaining within the binder possibly causes the image not to be decolored satisfactorily or possibly impairs the stability of the decolored state.

In the present invention, a basic compound may be used in order to avoid that the decoloration of the image is adversely affected by the unreacted carboxylic acid or phenol. In the case of using a basic compound, it is possible to avoid adverse influence to the decoloration of the image, even if the image is formed on a paper sheet having a pH value smaller than 8.

The basic compound used in the present invention is not particularly limited. Both inorganic and organic basic compounds can be used in the present invention.

Suitable inorganic basic compounds used in the present invention include, for example, calcium chloride, potassium hydroxide, calcium hydroxide, sodium hydroxide, barium hydroxide, magnesium hydroxide, ammonium carbonate, potassium carbonate, calcium carbonate, sodium carbonate, magnesium carbonate, ammonium hydrogencarbonate, potassium hydrogencarbonate, sodium hydrogencarbonate, alkaline metal borates, tripotassium phosphate, dipotassium hydrogenphosphate, calcium phosphate, trisodium phosphate, and disodium hydrogenphosphate.

Suitable organic compounds used in the present invention include, for example, primary to tertiary amines and quaternary ammonium salt. The counter ions of the quaternary ammonium salt include, for example, hydroxyl ion, halogen ion and alkoxide ion.

The non-aromatic organic basic compounds used in the present invention include, for example, compounds having aliphatic hydrocarbon group having 1 to 50 carbon atoms or having alicyclic hydrocarbon group having 1 to 50 carbon atoms. It is possible for these hydrocarbon groups to be substituted by at least one substituent selected from the group consisting of vinyl group, ethynylene group, ethynyl group, oxy group, oxycarbonyl group, thiocarbonyl group, dithiocarbonyl group, thio group, sulfinyl group, sulfonyl group, carbonyl group, hydrazo group, azo group, azido group, nitrilo group, diazoamino group, imino group, urea bond, thiourea bond, amide bond, urethane bond, and carbonyldioxy group.

The aromatic organic basic compounds used in the present invention include, for example, those having an aromatic ring such as benzene ring, biphenyl ring, naphthalene ring, tetralone ring, phenanthrene ring, indene ring, indan ring, pentalene ring, azulene ring, heptalene ring and fluorene ring. It is possible for an aliphatic hydrocarbon group having 1 to 50 carbon atoms or an alicyclic hydrocarbon group having 1 to 50 carbon atoms to be substituted in these aromatic rings. Further, it is possible for the substituents given above to be substituted in these hydrocarbon groups, The cyclic amines used in the present invention include, for example, aziridine, azetidine, pyrroline, pyrrolidine, indoline, pyridine, piperidine, hydropyridine, quinoline, isoquinoline, tetrahydroquinoline, tetrahydroisoquinoline, acridine, phenanthridine, phenanthroline, pyrazole, benzimidazole, pyridazine, pyrimidine, pyrazine, imidazole, histamine, decahydroquinoline, pyrazoline, imidazoline, piperazine, cinnoline, phtharazine, quinazoline, quinoxaline, dihydrophenazine, triazole, benzotriazole, triazine, tetrazole, pentamethylenetetrazole, tetrazine, purine, pteridine, carboline, naphthyridine, indolizine, quinolizine, quinuclidine, oxazole, benzoxazole, isoxazole, anthranil, oxazine, oxazoline, thiazole, thiazolidine, benzothiazole, benzothiazoline, isothiazole, thiazine, azoxim, furazan, oxadiazine, thiadiazole, benzothidiazole, thiadiazine, dithiazine, morpholine, hexamethylenetetramine, and diazabicycloundecene.

The additional organic basic compounds used in the present invention include, for example, guanidine, aminoguanidine, urea, thio urea, semicarbazide, and carbonohydrazide.

In the present invention, the basic compounds can be mixed as they are with the other components of the image forming material. Also, it is desirable to mix the basic compounds, which are sealed in microcapsules, with the other components of the image forming material.

For a shell material of microcapsules, selected is a material which can be broken when the image forming material is heated to be decolored and can release the basic compounds sealed in the microcapsules. The temperature where the microcapsules are broken should preferably be 120 to 200° C. Examples of suitable shell material are polyether sulfone, polyether ketone, epoxy resin, polyethylene, polypropylene, polyphenylene ether, polyphenylene sulfite, polyalkylene oxide, polystyrene, polyphenol ether, nylon, polyamide, polyurethane, gelatin, polymethacrylic acid, polyimide, melamine resin, polyester, polyacrylic acid, polysiloxane, polysulfide, gum arabic, polyvinyl pyrrolidone, polycarbonate, polysulfone, polyisocyanate and polypyrrole. These compounds can be used singly or in combination of two or more species. Also, a copolymer of these compounds may be used.

In the present invention, an image may be formed by using an image forming material containing a color former, a developer, a decolorizer and a binder consisting of a polyester or an epoxy resin. In decoloring the image, a method can be used in which the image forming material is brought into contact with a solvent containing a basic compound, followed by heating.

In the present invention, an image may be formed by using an image forming material containing a color former, a developer and a binder consisting of a polyester or an epoxy resin. In decoloring the image, a method can be used in which the image forming material is brought into contact with a solvent containing a basic compound and a decolorizer. It should be noted that a method may be used in which a solvent containing a basic compound and another solvent containing a decolorizer are separately brought into contact with the image forming material.

In bringing the solvent containing a basic compound into contact with the image forming material, the solvent may be sprayed onto a paper sheet bearing the image. Alternatively, the paper sheet may be immersed in a solution. Further, after being brought into contact with the solvent containing a basic compound and, if desired, a decolorizer, the image forming material may be heated.

The solvent used for preparing a solution of a basic compound is not particularly limited as far as the basic compound can be dissolved in the solvent. The solvents used for this purpose include, for example, water, methyl alcohol, ethyl alcohol, isopropyl alcohol, acetone, methylene chloride, ethyl acetate, ethyl lactate, ethyl butyrate, n-pentyl butyrate, ethyl ether, tetrahydrofuran, ethyleneglycol dimethyl ether, ethyleneglycol diethyl ether, cellosolve acetate, γ-butyrolactone, β-butyrolactone, N-methyl pyrrolidinone, dimethyl formamide, dimethyl acetamide, dimethyl sulfoxide, methyl ethyl ketone, methyl isopropyl ketone, toluene, xylene, hexane, pentane, heptane, petroleum fractions such as petroleum ether and benzine. It is desirable for the basic compound solution to have a concentration of 1 to 40% by weight.

In order to perform a method of decoloring an image using a solvent, an image decoloring apparatus comprising a means for bringing an image forming material into contact with a solvent, and a means for removing the solvent from a paper sheet.

For bringing the image forming material which has developed color on a paper sheet into contact with a solvent, it is possible to use a roller for immersing the paper sheet in a solvent housed in a container, a spray nozzle for spraying the solvent onto the paper sheet, a nozzle for dripping the solvent onto the paper sheet, and a gravure roller for supplying the solvent onto the paper sheet. On the other hand, the solvent can be removed from the paper sheet by using, for example, a hot air, an infrared ray lamp, a heat roller, a hot press, a thermal printer head (TPH) and a thermal bar. Where the solvent used is likely to be evaporated, the paper sheet may be subjected to a natural drying. Further, it is desirable to use a solvent recovery means used in the apparatus of the present invention.

FIGS. 1 to 5 exemplify image decoloring apparatuses using a solvent.

In the decoloring apparatus shown in FIG. 1, a solvent container 101 and a solvent tank 103 for supplying a solvent 102 into the solvent container 101 are arranged in a bottom portion of the apparatus. Paper sheets each having an image formed thereon is fed one by one with the formed image facing downward by a transfer roller 104 into the apparatus and, then, transferred by carrier rollers. The paper sheet is transferred through a clearance between a immersing roller 105 and counter rollers 106. During the transfer, the paper sheet is immersed in the solvent 102 housed in the solvent container 101 so as to have the formed image decolored. The paper sheet is further transferred into an upper region of the apparatus by carrier rollers so as to be exposed to a hot air generated from a radiator of an electronic cooler described herein later and, then, heated by a heat roller 107 so as to be smoothed. After removal of the solvent, the paper sheet is transferred by a transfer roller 108 out of the apparatus so as to be housed in a stocker. It is possible for the transfer rollers 104 and 108 to be equipped with electric switches to permit these rollers to be operated or stopped when the paper sheet is transferred into and out of the decoloring apparatus. It is desirable for each roller to be formed of a material resistant to a solvent and producing an antistatic effect.

In the decoloring apparatus shown in FIG. 1, the paper sheet is immersed in the solvent 102 housed in the solvent container 101. Naturally, the solvent can be supplied in an amount large enough to achieve the decoloring to the paper sheet regardless of the amount of the image forming material on the paper sheet. Also, the decolored state can be maintained stable, making it possible to reuse the paper sheet effectively. It should also be noted that, if the surface of the image forming material on the paper sheet is roughened by the counter roller 108, the quality of the decolored paper sheet can be improved.

The apparatus comprises a solvent recovery mechanism. The recovery mechanism comprises mainly a recovery vessel in which are housed an adsorbent 110, an electronic cooler 111, and a circulation pump 114. The used solvent is recovered from the solvent container 101 into a recovered solvent container 109. The solvent evaporated in the recovered solvent container 109 is adsorbed on the adsorbent 110 cooled by the electronic cooler 111, e.g., a Peltier element. The temperature of the electronic cooler 111 is set to permit the vapor pressure of the solvent to be 100 ppm or less. The solvent adsorbed on the absorbent 110 is sucked by a circulation pump 114 so as to be absorbed by an absorption filter 113. It is desirable to use an orifice pump excellent in resistance to explosion as the circulation pump. It is possible to prevent the pump material from being corroded by the solvent by arranging the absorption filter 113 upstream of the circulation pump 114. It is also possible to use a dehumidifier in order to prevent the water within the atmosphere from entering the system. The hot air generated from the radiator 112 of the electronic cooler 111 is utilized for drying the paper sheet after immersing in the solvent as described previously. The apparatus of the type shown in FIG. 1 can be miniaturized so as to be used in an office.

Figure 2:
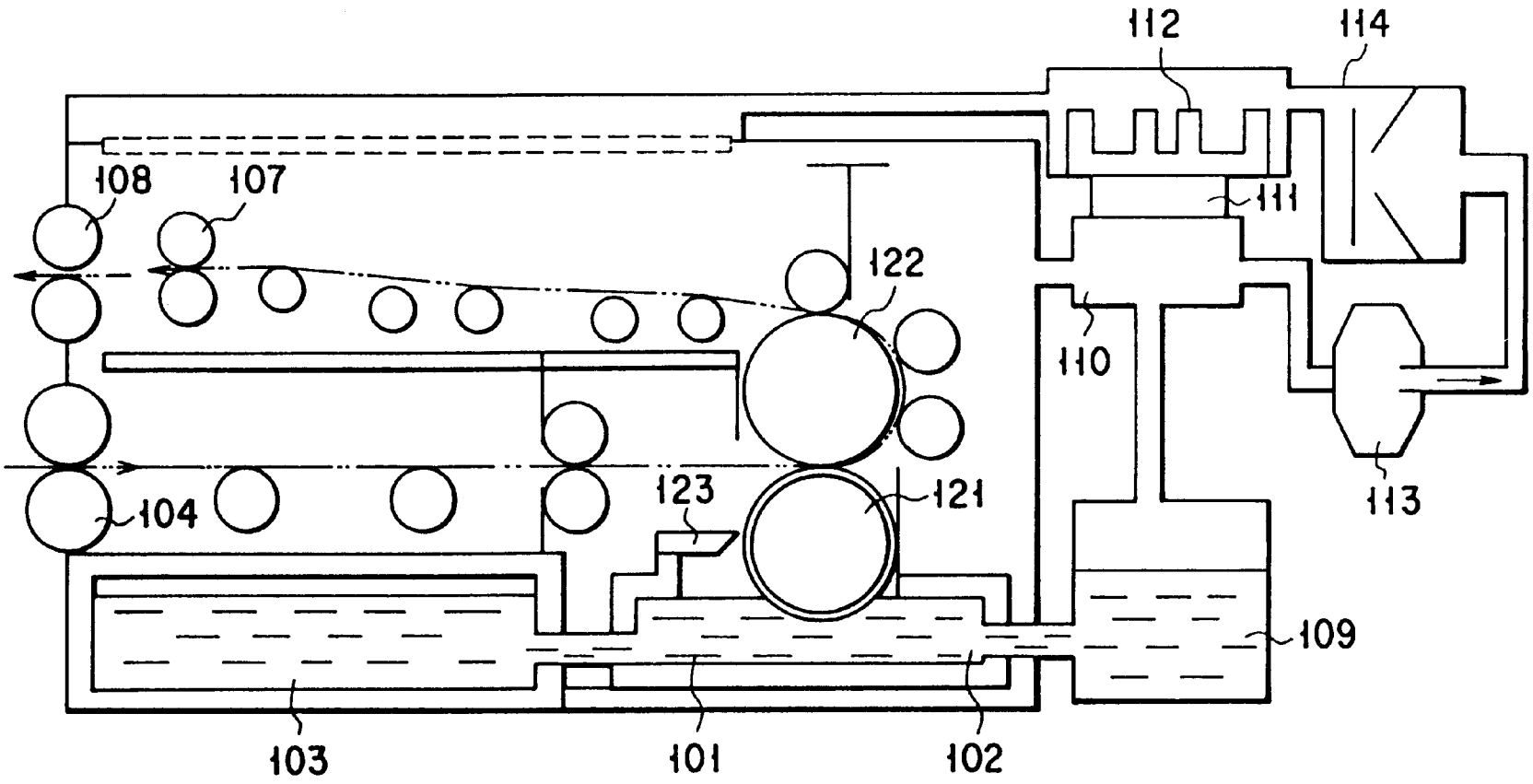
FIG. 2 shows another image decoloring apparatus using a solvent according to the present invention.

The decoloring apparatus shown in FIG. 2 is substantially equal in construction to the apparatus shown in FIG. 1, except that a gravure roller 121 is used in the apparatus of FIG. 2 for bringing a solvent into contact with the image forming material on the paper sheet. The gravure roller 121 is rotated so as to be immersed in the solvent 102 housed in the solvent container 101 and, then, the amount of the solvent attached to the surface is controlled by a blade 123. When the paper sheet fed into the apparatus is passed through the clearance between the gravure roller 121 and the counter roller 122, the solvent is supplied by the gravure roller 121 to the paper sheet so as to achieve decoloration.

In the apparatus shown in FIG. 2, the smallest amount of the solvent required for the decoloration is supplied by the gravure roller 121 onto the paper sheet, making it possible to shorten the time required for removing the solvent from the paper sheet. As a result, the process rate of the paper sheet is improved. Also, since the image forming material remaining on the paper sheet is roughened by the rubbing with the gravure roller, the quality of the decolored paper sheet is improved.

Figure 3:
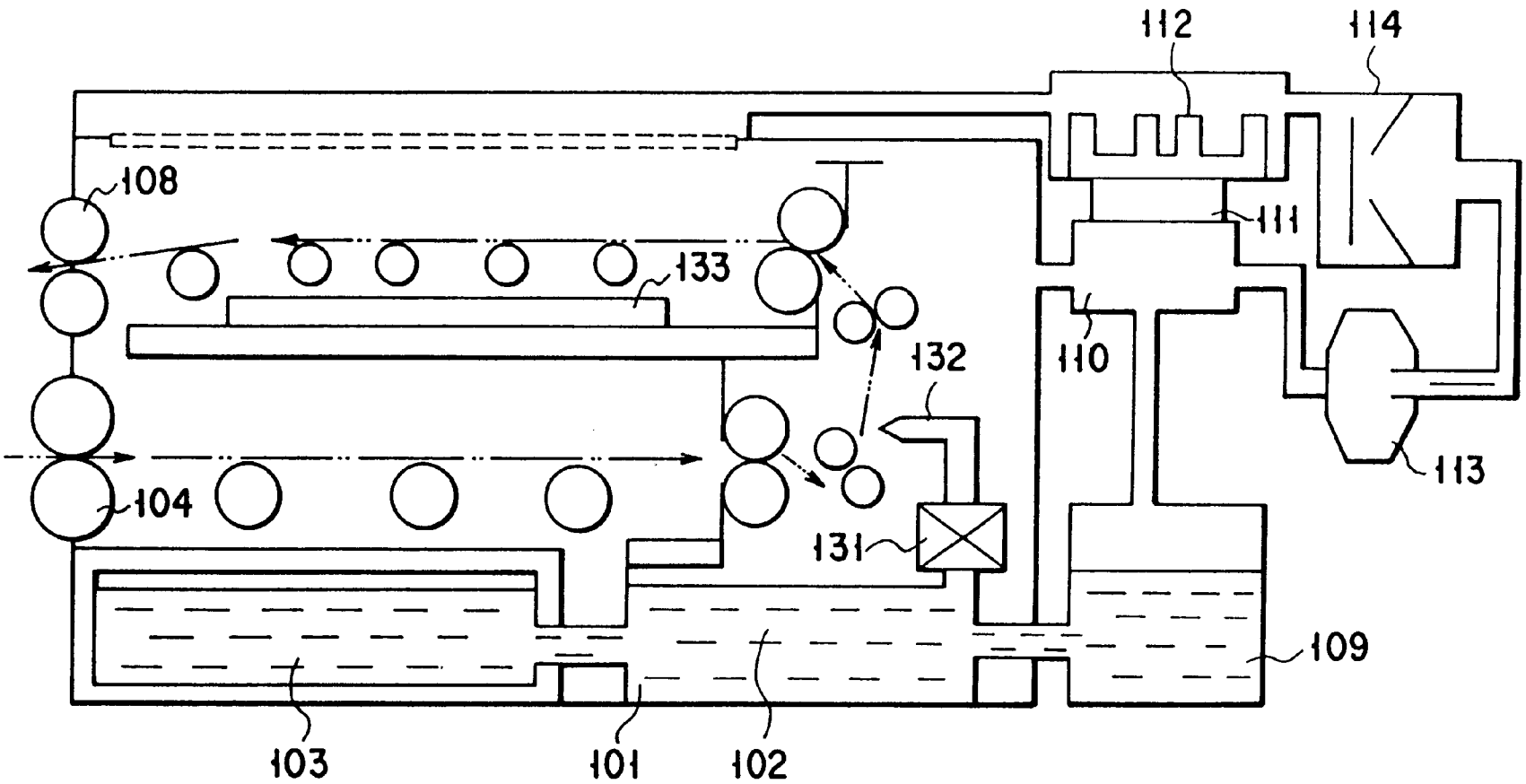
FIG. 3 shows another image decoloring apparatus using a solvent according to the present invention.

The decoloring apparatus shown in FIG. 3 is substantially equal in construction to the apparatus shown in FIG. 1, except that the apparatus shown in FIG. 3 comprises a pump 131 and a spray nozzle 132 as a means for bringing the solvent into contact with the image forming material on the paper sheet, and a lamp heater 133 for removing the solvent from the paper sheet. In the apparatus shown in FIG. 3, the solvent 102 is pumped out by the pump 131 from the solvent container 101 so as to be sprayed onto the paper sheet from the nozzle 132, thereby to achieve decoloration. Then, the paper sheet is dried by a hot air and, at the same time, heated by the lamp heater 133 so as to remove the solvent from the paper sheet.

In the apparatus shown in FIG. 3, a sufficiently large amount of the solvent can be supplied by the pump 131 onto the paper sheet. In addition, the lamp heater 133 permits improving the solvent removing rate from the paper sheet. It follows that the apparatus shown in FIG. 3 is superior to the apparatus shown in FIG. 1 or 19 in the paper sheet processing rate. What should also be noted is that the solvent flows down along the surface of the paper sheet so as to spread the image forming material. As a result, the quality of the decolored paper sheet is improved.

Figure 4A:
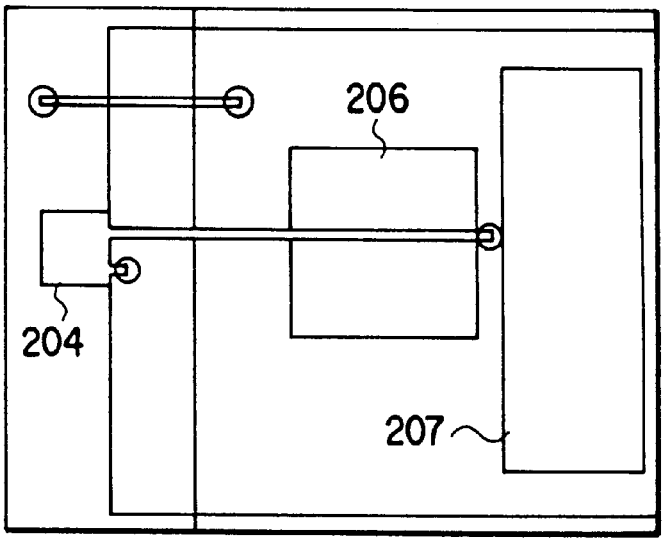
FIGS. 4A to 4C show another image decoloring apparatus using a solvent according to the present invention.
Figure 4B:
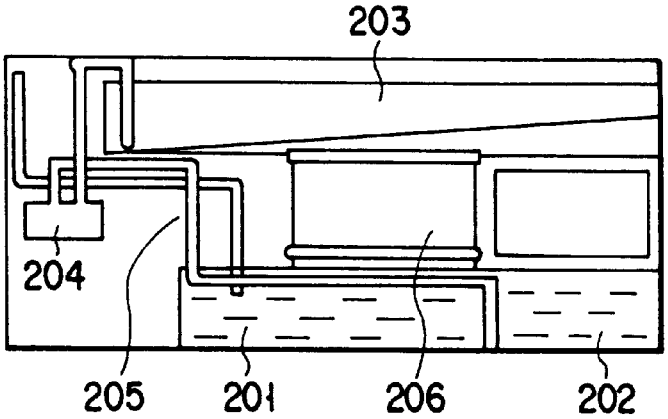
Figure 4C:
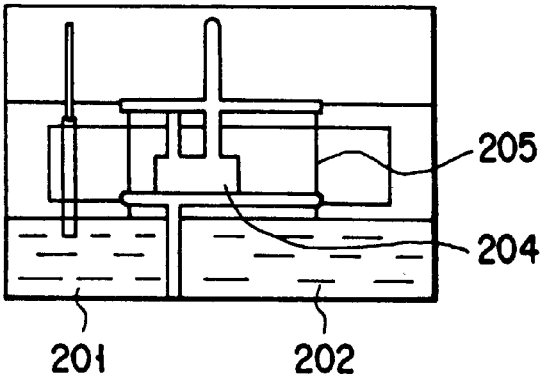

FIGS. 4A to 4C collectively exemplifies a batch type decoloring apparatuses. FIG. 4A is a plan view of the apparatus, with FIGS. 4B and 4C being side views. As shown in the drawings, a solvent 202 is housed in a solvent tank 201 arranged in a bottom portion of the apparatus. A solvent immersing vessel 203 is arranged in an upper portion of the apparatus. A chemical pump 204 and a pipe 205 connected to the chemical pump 204 are arranged between the solvent tank 201 and the solvent immersing vessel 203. Further, an electronic cooler 206, e.g., a Peltier element, is arranged below the solvent immersing vessel 203 such that a radiator of the electronic cooler 206 faces upward. An electric power is supplied from a power source 207 to the electronic cooler 206.

For performing the decoloration, a lid of the solvent immersing vessel 203 is opened, and a bundle of, for example, 100 paper sheets is put in the vessel 203. Under this condition, the chemical pump 204 is operated to supply the solvent 202 from the solvent tank 201 into the solvent immersing vessel 203 so as to immerse the paper sheets in the solvent for the decoloring purpose. Then, the chemical pump 204 is operated again to cause the solvent to flow from the solvent immersing vessel 203 back to the solvent tank 201. Further, the solvent is removed from the paper sheet by utilizing the heat radiated from the electronic cooler 206. The paper sheets thus decolored can be used again effectively. It is also possible to use the recovered paper sheets for manufacturing regenerated paper sheets. Further, the evaporated solvent can be cooled by the electronic cooler 206 for recovering the solvent. Incidentally, a heat exchanger can be used in place of the electronic cooler shown in FIG. 4. The apparatus shown in FIG. 4 is capable of processing the paper sheets on the order of 100 kg/day.

Figure 5:
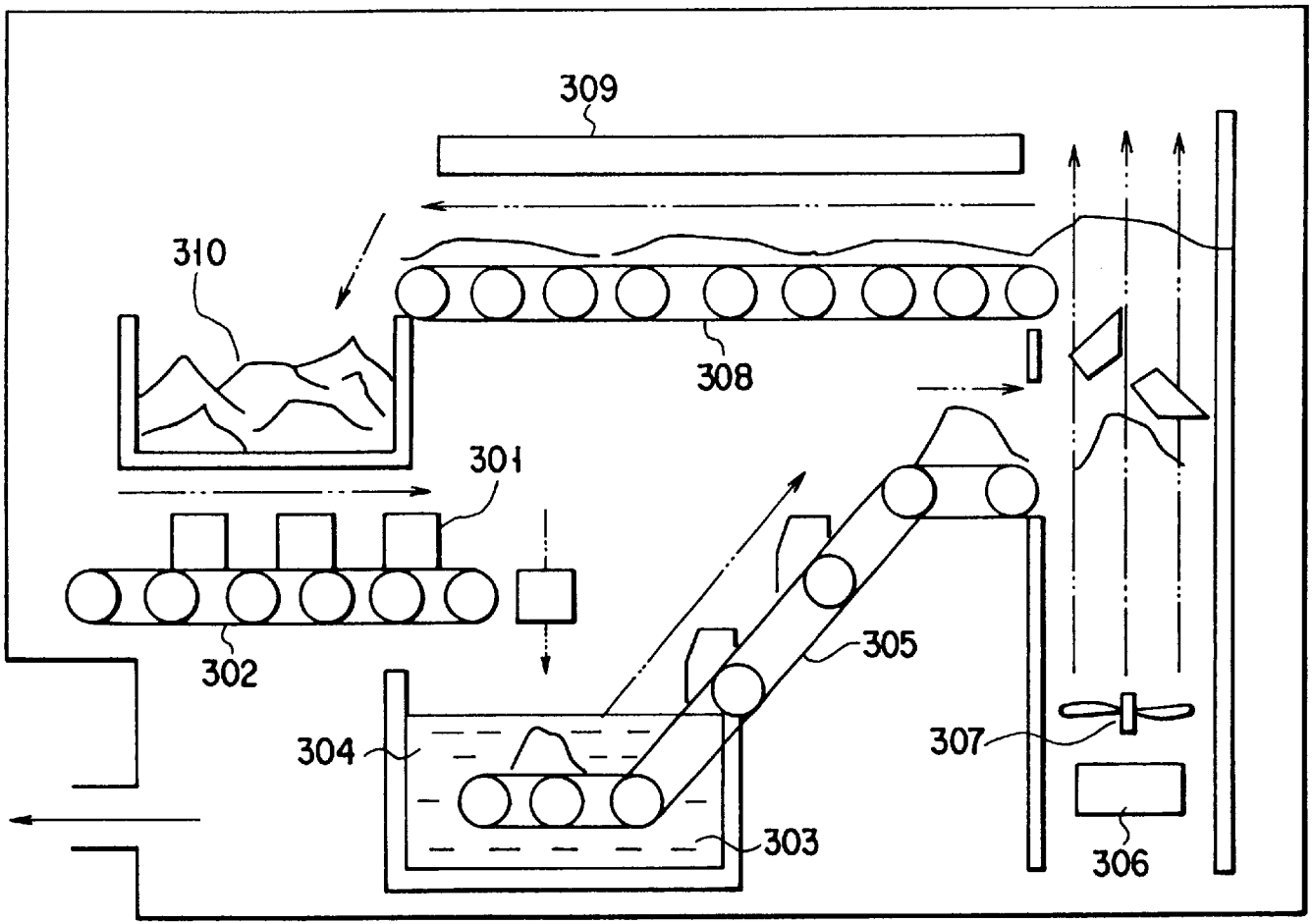
FIG. 5 shows still another image decoloring apparatus using a solvent according to the present invention.

FIG. 5 exemplifies an in-line type large plant using a solvent. In this plant, bundles 301 of paper sheets are transferred by a belt conveyor 302 into a solvent processing vessel 303 so as to be immersed in a solvent 304 for the decoloring purpose. The bundles 301 of the paper sheets are taken out of the solvent processing vessel 303 by a belt conveyor 305 so as to be transferred into a primary drying station in which these paper sheets are exposed to a hot air generated from a heater 306 and blown by a fan 307. As a result, these paper sheets are scattered and dried and, then, transferred into a secondary drying station in which these paper sheets are transferred by a belt conveyor 308. During the transfer in the secondary drying station, the scattered paper sheets are completely dried by an infrared heater 309. The dried paper sheets are stored in a stock room 310. In this apparatus, the recovered paper sheets can be effectively used again. It is also possible to use the recovered paper sheets for manufacturing regenerated paper sheets. It should be noted that the evaporated solvent generated from the entire plant is recovered in a fractionator (not shown) so as to be used again as a decoloring solvent in the solvent processing vessel. The apparatus of this type is capable of processing paper sheets in an amount of scores of tons/day.

In a plant of the type shown in FIG. 5, it is desirable to use a solvent for its own use. For example, it is desirable to use a mixed solvent consisting of a ketone type solvent exhibiting a high decoloring rate and toluene that is a good solvent for the binder. Further, a decolorizer should desirably be added to the mixed solvent noted above.

EXAMPLES

Examples of the present invention will be described below. In the Examples described below, an image was formed on a paper sheet (pH=9.4) manufactured by Neusiedler Ltd., which is typically used in Europe. The paper sheet exhibits a reflection density of 0.07.

Example 1

One part by weight of crystal violet lactone (CVL) as a color former, one part by weight of propyl gallate as a developer, 10 parts by weight of cholesterol and 10 parts by weight of D-glucose as decolorizers, 77 parts by weight of polystyrene having an average molecular weight of 45,000 as a binder, and one part by weight of LR-147 (available from JAPAN CARLIT Ltd.) as a charge control agent were mixed and kneaded with a kneader. The kneaded mixture was pulverized with a pulverizer to obtain a powdery material having an average particle size of 10 $\mu$m. Then, 1% by weight of hydrophobic silica was added to 100% by weight of the powdery material so as to prepare a toner. The resultant toner was put in a cartridge of a copying machine so as to transfer an image onto a paper sheet.

On the other hand, an organic solvent shown in Table 1 was put in an image decoloring apparatus shown in FIG. 2, and the solvent was brought into contact with the paper sheet having an image formed thereon so as to decolor the image from the paper sheet, followed by drying the paper sheet. Table 1 shows the reflection density of the paper sheet having the image decolored therefrom. As apparent from Table 1, the reflection density after decoloration of the image was found to be substantially equal to the initial reflection density regardless of the kind of the organic solvent used.

TABLE 1

| Organic Solvent | Reflection Density |
|---|---|
| ethyleneglycol diethyl ether | 0.07 |
| isoamyl butyrate | 0.07 |
| methyl ethyl ketone | 0.07 |
| tetrahydrofuran | 0.08 |
| ethyl propyl ether | 0.08 |
| dioxolane | 0.08 |
| cyclohexanone | 0.07 |
| ethyl lactate | 0.08 |
| γ-butyrolactone | 0.08 |
| methyl alcohol/toluene (mixing ratio 1:1) | 0.08 |
| ethyl alcohol/xylene (mixing ratio 1:2) | 0.08 |
| cyclohexanol/toluene (mixing ratio 1:3) | 0.07 |
| isopropyl alcohol/ethyl acetate (mixing ratio 1:2) | 0.07 |
| isopropyl alcohol/toluene (mixing ratio 1:1) | 0.08 |
| methyl ethyl ketone/hexane (mixing ratio 1:1) | 0.09 |

The paper sheet having the image decolored therefrom was left to stand at 60° C. for 300 hours. However, the image did not appear again on the paper sheet. Then, another image was transferred onto the paper sheet from which the image formed previously was decolored. The image transfer-decoloration process was repeated nine times, followed by transferring a tenth image onto the paper sheet. The quality of the tenth image was found to be substantially equal to that of the first image transferred onto the paper sheet. Further, the copying-decoloring was repeated 50 times, with the result that the copied image and the decolored state were satisfactory in quality after the 50th copying-decoloring operation, though the paper sheet was found to have been physically damaged to some extent.

Example 2

A toner was prepared as in Example 1, except that polystyrene having a molecular weight of 45,000 was added as a binder in amounts as shown in Table 2. The toner thus prepared was put in a cartridge of a laser beam printer for printing an image onto a paper sheet.

On the other hand, ethyleneglycol diethyl ether as a solvent was put in an image decoloring apparatus shown in FIG. 1. The paper sheet having the image printed thereon was kept immersed in the solvent for 30 seconds so as to decolor the printed image, followed by drying the paper sheet. Table 2 shows the reflection density of the paper sheet having the image decolored therefrom. In the case of using the toner having the polystyrene content of 20 to 25% by weight, the image forming material was found to have been eluted out of the paper sheet while the paper sheet was kept immersed in the solvent so as to leave marks on the paper sheet. Therefore, the reflection density was not measured. In the case of using the toner having the polystyrene content of 30% by weight or more, the reflection density of the paper sheet after decoloration of the image was found to have been substantial equal to the initial reflection density, supporting that the image was decolored satisfactorily. The stability of the decolored state was also found to be satisfactory as in Example 1.

TABLE 2

| Polystyrene content of Toner (% by weight) | Reflection Density |
|---|---|
| 20 | — |
| 25 | — |
| 30 | 0.07 |
| 40 | 0.07 |
| 50 | 0.07 |
| 60 | 0.07 |
| 70 | 0.07 |
| 80 | 0.07 |
| 90 | 0.07 |

Example 3

A toner was prepared as in Example 1, except that polystyrene molecular differing from each other in the average molecular weight was added as a binder in amounts as shown in Table 3. The toner thus prepared was put in a cartridge of a facsimile for printing an image onto a paper sheet.

On the other hand, ethyleneglycol diethyl ether as a solvent was put in an image decoloring apparatus shown in FIG. 3. The solvent was kept sprayed onto the paper sheet having the image printed thereon 30 seconds so as to decolor the image, followed by drying the paper sheet. Table 3 shows the reflection density of the paper sheet having the image decolored therefrom. As apparent from Table 3, it is desirable to set the polystyrene content at a low level in the case of using polystyrene having a large molecular weight.

TABLE 3

| Average Molecular Weight of Polystyrene | Polystyrene Content of Toner (% by weight) | Reflection Density |
|---|---|---|
| 45,000 | 40 | 0.07 |
| 45,000 | 85 | 0.09 |
| 45,000 | 90 | 0.18 |
| 220,000 | 40 | 0.07 |
| 220,000 | 75 | 0.07 |
| 220,000 | 85 | 0.12 |
| 630,000 | 40 | 0.07 |
| 630,000 | 70 | 0.09 |
| 630,000 | 80 | 0.25 |
| 630,000 | 90 | 0.52 |

Example 4

A toner was prepared as in Example 1, except that the binder used consisted of 77 parts by weight of styrene/n-butyl methacrylate copolymer having an average molecular weight of 130,000 (n-butyl methacrylate content being 10% by weight). The toner thus prepared was put in a cartridge of a copying machine for transferring an image onto a paper sheet.

On the other hand, the organic solvent shown in Table 4 was put in a container, and the paper sheet having an image formed thereon was kept immersed in the solvent for 30 seconds so as to decolor the image, followed by drying the paper sheet. Table 4 shows the reflection density of the paper sheet having the image decolored therefrom. As apparent from Table 4, the reflection density of the paper sheet after decoloration of the image was found to be substantially equal to the initial reflection density regardless of the kind of the organic solvent used. The stability of the decolored state was also found to be satisfactory as in Example 1.

TABLE 4

| Organic Solvent | Reflection Density |
|---|---|
| ethyleneglycol diethyl ether | 0.07 |
| isoamyl butyrate | 0.07 |
| methyl ethyl ketone | 0.07 |
| tetrahydrofuran | 0.07 |
| ethyl propyl ether | 0.07 |
| dioxolane | 0.07 |
| cyclohexanone | 0.07 |
| ethyl lactate | 0.08 |
| γ-butyrolactone | 0.08 |
| methyl alcohol/toluene (mixing ratio 1:1) | 0.08 |
| ethyl alcohol/xylene (mixing ratio 1:2) | 0.07 |
| cyclohexanol/toluene (mixing ratio 1:3) | 0.07 |
| isopropyl alcohol/ethyl acetate (mixing ratio 1:2) | 0.07 |
| isopropyl alcohol/toluene (mixing ratio 1:1) | 0.08 |
| methyl ethyl ketone/hexane (mixing ratio 1:1) | 0.08 |

Example 5

A toner was prepared as in Example 1, except that the binder used consisted of styrene/n-butyl methacrylate copolymer having an average molecular weight of 130,000 (n-butyl methacrylate content being 10% by weight). In this experiment, the binder amount was changed as shown in Table 5. The toner thus prepared was put in a cartridge of a laser beam printer for printing an image onto a paper sheet.

On the other hand, ethyleneglycol diethyl ether as a solvent was put in a container. The paper sheet having the image printed thereon was kept immersed in the solvent for 30 seconds so as to decolor the printed image, followed by drying the paper sheet. Table 5 shows the reflection density of the paper sheet having the image decolored therefrom. In the case of using the toner having the binder content of 15 to 20% by weight, the image forming material was found to have been eluted out of the paper sheet while the paper sheet was kept immersed in the solvent so as to leave marks on the paper sheet. Therefore, the reflection density was not measured. In the case of using the toner having the binder content of 30% by weight or more, the reflection density of the paper sheet after decoloration of the image was found to have been substantially equal to the initial reflection density, supporting that the image was decolored satisfactorily. The stability of the decolored state was also found to be satisfactory as in Example 1.

TABLE 5

| Binder content of Toner (% by weight) | Reflection Density |
|---|---|
| 15 | — |
| 20 | — |
| 30 | 0.07 |
| 55 | 0.07 |
| 65 | 0.07 |
| 75 | 0.07 |
| 85 | 0.07 |
| 95 | 0.07 |
| 98 | 0.12 |

Example 6

A toner was prepared as in Example 1, except that styrene/n-butyl methacrylate copolymer (n-butyl methacrylate content being 10% by weight) differing from each other in the average molecular weight was added as a binder in amounts as shown in Table 6. The toner thus prepared was put in a cartridge of a facsimile for transferring an image onto a paper sheet.

On the other hand, ethyleneglycol diethyl ether as a solvent was put in an image decoloring apparatus shown in FIG. 1. The paper sheet having the image printing thereon was kept immersed in the solvent for 30 seconds so as to decolor the image, followed by drying the paper sheet. Table 6 shows the reflection density of the paper sheet having the image decolored therefrom. As apparent from Table 6, it is desirable to set the binder content at a low level in the case of using a binder having a large molecular weight.

TABLE 6

| Average Molecular Weight of Binder | Binder Content of Toner (% by weight) | Reflection Density |
|---|---|---|
| 130,000 | 40 | 0.07 |
| 130,000 | 85 | 0.09 |
| 130,000 | 98 | 0.12 |
| 352,000 | 40 | 0.07 |
| 352,000 | 80 | 0.07 |

TABLE 6-continued

| Average Molecular Weight of Binder | Binder Content of Toner (% by weight) | Reflection Density |
|---|---|---|
| 352,000 | 90 | 0.21 |
| 850,000 | 40 | 0.07 |
| 850,000 | 70 | 0.07 |
| 850,000 | 80 | 0.25 |
| 850,000 | 90 | 0.52 |

Example 7

A toner was prepared as in Example 1, except that styrene/n-butyl methacrylate copolymers having an average molecular weight of 130,000 and differing from each other in the n-butyl methacrylate content was added as a binder in amounts as shown in Table 7. The toner thus prepared was put in a cartridge of a copying machine for transferring an image onto a paper sheet.

On the other hand, ethyleneglycol diethyl ether as a solvent was put in an image decoloring apparatus shown in FIG. 1. The paper sheet having the image printed thereon was kept immersed in the solvent for 30 seconds so as to decolor the image, followed by drying the paper sheet. Table 7 shows the reflection density of the paper sheet having the image decolored therefrom. As apparent from Table 7, the reflection density of the paper sheet after decoloration of the image was substantially equal to the initial reflection density, supporting that the image was decolored satisfactorily regardless of the kind of the binder contained in the toner. The stability of the decolored state was also found to be satisfactory as in Example 1.

TABLE 7

| n-butyl methacrylate/ styrene (% by weight) | Binder Content of Toner (% by weight) | Reflection Density |
|---|---|---|
| 5 | 85 | 0.07 |
| 10 | 85 | 0.07 |
| 15 | 85 | 0.07 |
| 20 | 85 | 0.07 |
| 25 | 85 | 0.07 |
| 30 | 90 | 0.07 |
| 35 | 90 | 0.07 |
| 40 | 90 | 0.08 |
| 45 | 80 | 0.08 |
| 50 | 80 | 0.08 |

Example 8

A toner was prepared as in Example 1, except that the binder used consisted of 77 parts by weight of styrene/acrylic copolymers having an average molecular weight of 130,000 and containing 10% by weight of acrylate monomer content as shown in Table 8. The toner thus prepared was put in a cartridge of a copying machine for transferring an image onto a paper sheet.

On the other hand, ethyleneglycol diethyl ether as a solvent was put in an image decoloring apparatus shown in FIG. 3. The solvent was kept sprayed onto the paper sheet having the image printed thereon so as to decolor the image, followed by drying the paper sheet. Table 8 shows the reflection density of the paper sheet having the image decolored therefrom. As apparent from Table 8, the reflection density of the paper sheet after decoloration of the image was substantially equal to the initial reflection density, supporting that the image was decolored satisfactorily regardless of the kind of the binder contained in the toner. The stability of the decolored state was also found to be substantially equal to that in Example 1.

TABLE 8

| Kind of Acrylate Monomer | Reflection Density |
|---|---|
| n-butyl methacrylate | 0.07 |
| isobutyl methacrylate | 0.07 |
| ethyl acrylate | 0.07 |
| n-butyl methacrylate | 0.07 |
| glycidyl methacrylate | 0.07 |
| diethylaminopropyl acrylate | 0.07 |
| 2-ethylhexyl acrylate | 0.07 |
| ethyleneglycol methacrylate | 0.07 |
| methyl methacrylate | 0.08 |
| dimethylaminoethyl methacrylate | 0.08 |

Example 9

A toner was prepared as in Example 1, except that the binder used consisted of 77 parts by weight of a blend polymer having an average molecular weight of 130,000 of polystyrene and 10% by weight of polyacrylate as shown in Table 9. The toner thus prepared was put in a cartridge of a copying machine for transferring an image onto a paper sheet.

On the other hand, ethyleneglycol diethyl ether as a solvent was put in a container. The paper sheet having the image formed thereon was immersed in the solvent so as to decolor the image, followed by drying the paper sheet. Table 9 shows the reflection density of the paper sheet having the image decolored therefrom. As apparent from Table 9, the reflection density of the paper sheet after decoloration of the image was substantially equal to the initial reflection density, supporting that the image was decolored satisfactorily regardless of the kind of the binder contained in the toner. The stability of the decolored state was also found to be substantially equal to that in Example 1.

TABLE 9

| Kind of Polyacrylate | Reflection Density |
|---|---|
| poly(n-butyl methacrylate) | 0.08 |
| poly(isobutyl methacrylate) | 0.08 |
| Poly(ethyl acrylate) | 0.09 |
| poly(n-butyl acrylate) | 0.09 |
| poly(glycidyl methacrylate) | 0.10 |
| poly(diethylaminopropyl acrylate) | 0.10 |
| poly(2-ethylhexyl acrylate) | 0.09 |
| poly(ethyleneglycol methacrylate) | 0.11 |
| poly(methyl methacrylate) | 0.13 |
| poly(dimethylaminoethyl methacrylate) | 0.10 |

Example 10

One part by weight of crystal violet lactone (CVL) as a color former, one part by weight of propyl gallate as a developer, 10 parts by weight of cholesterol and 10 parts by weight of D-glucose as decolorizers, 72 parts by weight of fumaric acid/etherified diphenol-based polyester having an average molecular weight of 11,500 as a binder, one part by weight of a charge control agent, and five parts by weight of a basic compound shown in Table 10 were mixed and kneaded by a kneader. The kneaded mixture was pulverized by a pulverizer so as to obtain a powdery material having an average particle size of 10 $\mu$m. Then, 1% by weight of hydrophobic silica was added to 100% by weight of the resultant powdery material so as to prepare a toner. The toner thus prepared was put in a cartridge of a laser beam printer so as to transfer an image onto a paper sheet.

The paper sheet having the image formed thereon was kept in contact for 30 seconds with a heat roller heated to 200° C. so as to decolor the image from the paper sheet. The reflection density of the paper sheet having the image decolored therefrom was measured, with the result as shown in Table 10. As shown in Table 10, the reflection density of the paper sheet after decoloration of the image was substantially equal to the initial reflection density, supporting that the image can be decolored satisfactorily from the paper sheet regardless of the kind of the basic compound used.

TABLE 10

| Kind of Basic Compound | Reflection Density |
|---|---|
| calcium chloride | 0.08 |
| ammonium hydroxide | 0.08 |
| tetramethylammonium hydroxide | 0.08 |
| calcium carbonate | 0.08 |
| ammonium carbonate | 0.08 |
| sodium hydroxide | 0.08 |
| patassium hydroxide | 0.08 |
| triethylamine | 0.08 |
| dibutylamine | 0.08 |
| butylamine | 0.08 |
| cyclohexylamine | 0.08 |
| dicyclohexylamine | 0.08 |
| pyridine | 0.08 |
| pyrazine | 0.08 |
| piperazine | 0.08 |

The paper sheet having the image decolored therefrom was left to stand at 60° C. for 300 hours. However, the image did not appear again on the paper sheet. Then, another image was transferred onto the paper sheet from which the image formed previously was decolored. The image transfer-decoloration process was repeated nine times, followed by transferring a tenth image onto the paper sheet. The quality of the tenth image was found to be substantially equal to that of the first image transferred onto the paper sheet. Further, the copying-decoloring was repeated 50 times, with the result that the copied image and the decolored state were satisfactory in quality after the 50th copying-decoloring operation, though the paper sheet was found to have been physically damaged to some extent.

Example 11

Four grams of a basic compound shown in Table 11 were added to a solution (37° C.) prepared by dissolving 4 g of gelatin in 40 mL of water, and then 45 mL of a solution (37° C.) containing 11 g of sodium sulfate was added thereto, thereby coacervation was induced. The resultant dispersion was cooled to 30° C., followed by leaving the dispersion to stand so as to separate microcapsules by means of decantation. Then, formaldehyde was added in an amount of 1 mL to 1 mL of the resultant microcapsules while keeping the mixture stirred for 5 minutes, followed by adding 2 ml of ethanol to the mixture while keeping the mixture stirred for 5 minutes and subsequently separating the microcapsules by filtration. The microcapsules thus obtained was washed with a cold water, followed by drying the water-washed microcapsules. In this fashion, prepared were microcapsules having a basic compound sealed therein.

In the next step, one part by weight of crystal violet lactone (CVL) as a color former, one part by weight of propyl gallate as a developer, 10 parts by weight of cholesterol and 10 parts by weight of D-glucose as decolorizers, 67 parts by weight of maleic acid/propyleneglycol-based polyester having an average molecular weight of 11,500 as a binder, one part by weight of a charge control agent, and 10 parts by weight of the microcapsules prepared as described above were mixed and kneaded by a kneader. The kneaded mixture was pulverized by a pulverizer so as to obtain a powdery material having an average particle size of 10 $\mu$m. Then, 1% by weight of hydrophobic silica was added to 100% by weight of the resultant powdery material so as to prepare a toner. The toner thus prepared was put in a cartridge of a copying machine so as to transfer an image onto a paper sheet.

The paper sheet having the image formed thereon was kept in contact with a heat roller heated to 200° C. so as to decolor the image from the paper sheet. The reflection density of the paper sheet having the image decolored therefrom was measured, with the result as shown in Table 11. As shown in Table 11, the reflection density of the paper sheet after decoloration of the image was substantially equal to the initial reflection density, supporting that the image can be decolored satisfactorily from the paper sheet regardless of the kind of the basic compound used. The stability of the decolored state was also found to be substantially equal to that in Example 10.

TABLE 11

| Kind of Basic Compound | Reflection Density |
|---|---|
| triethylamine | 0.08 |
| dibutylamine | 0.08 |
| butylamine | 0.08 |
| cyclohexylamine | 0.08 |
| dicyclohexylamine | 0.08 |
| pyridine | 0.08 |
| pyrazine | 0.08 |
| piperazine | 0.08 |

Example 12

A toner was prepared as in Example 10, except that used in Example 12 were 72 parts by weight of maleic acid/etherified diphenol-based polyester as a binder and 5 parts by weight of dibutyl amine as a basic compound. The toner thus prepared was put in a cartridge of a copying machine so as to transfer an image onto a paper sheet.

On the other hand, an organic solvent shown in Table 12 was put in an image decoloring apparatus shown in FIG. 2. The organic solvent was kept in contact with the paper sheet having the image formed thereon for 30 seconds so as to decolor the image from the paper sheet, followed by drying the paper sheet. Table 12 shows the reflection density of the paper sheet having the image decolored therefrom. As shown in Table 12, the reflection density after decoloration of the image was found to be substantially equal to the initial reflection density, supporting that the image was decolored satisfactorily regardless of the kind of the organic solvent used. The stability of the decolored state was also found to be satisfactory as in Example 10.

TABLE 12

| Kind of Organic Solvent | Reflection Density |
|---|---|
| ethyleneglycol diethyl ether | 0.07 |
| isoamyl butyrate | 0.07 |
| methyl ethyl ketone | 0.07 |
| tetrahydrofuran | 0.07 |
| ethyl propyl ether | 0.07 |
| dioxolane | 0.08 |
| cyclohexanone | 0.07 |
| ethyl lactate | 0.08 |
| γ-butyrolactone | 0.08 |
| methyl alcohol/toluene (mixing ratio 1:1) | 0.08 |
| ethyl alcohol/xylene (mixing ratio 1:2) | 0.07 |
| cyclohexanol/toluene (mixing ratio 1:3) | 0.07 |
| isopropyl alcohol/ethyl acetate (mixing ratio 1:2) | 0.07 |
| isopropyl alcohol/toluene (mixing ratio 1:1) | 0.08 |
| methyl ethyl ketone/hexane (mixing ratio 1:1) | 0.09 |

Example 13

One part by weight of ODB-2 (available from Yamamoto Kasei K.K.) as a color former, one part by weight of 2,4,4'-trihydroxybenzophenone as a developer, 10 parts by weight of 1,2:5,6-diisopropylidene-D-mannitol and 10 parts by weight of D-fructose as decolorizers, 3 parts by weight of pyromellitic acid/ethylene glycol-based polyester having a molecular weight of 2,500 as a binder, and 15 parts by weight of paraffin were mixed and sufficiently kneaded using a kneader. Then, a PET sheet 4.5 $\mu$m thick was coated with the kneaded mixture in a thickness of about 2 $\mu$m using a hot melt coater so as to prepare a thermal transfer sheet. The thermal transfer sheet thus prepared was disposed on a paper sheet to form a laminate structure, and the resultant laminate structure was set in a thermal printer so as to print an image onto the paper sheet.

On the other hand, prepared was a solution containing 3% by weight of a basic compound shown in Table 13. The solvent used for preparation of the solution was selected from the group consisting of water, ethanol and acetone depending on the kind of the basic compound, as shown in Table 13.

The paper sheet having the image printed thereon was kept immersed for one minute in the solution of the basic compound shown in Table 13, followed by drying the paper sheet and subsequently blowing a hot air of 200° C. onto the paper sheet so as to decolor the printed image. Table 13 also shows the reflection density of the paper sheet having the image decoloerd therefrom. As shown in Table 13, the reflection density of the paper sheet after decoloration of the image was substantially equal to the initial reflection density, indicating that the image was decolored satisfactorily regardless of the kind of the basic compound used. The stability of the decolored state was also found to be satisfactory as in Example 10.

TABLE 13

| Kind of Basic Compound (Solvent) | Reflection Density |
|---|---|
| calcium chloride (water) | 0.07 |
| ammonium hydroxide (water) | 0.08 |
| tetramethylammonium hydroxide (water) | 0.08 |
| calcium carbonate (water) | 0.07 |
| ammonium carbonate (water) | 0.08 |
| sodium hydroxide (water) | 0.08 |
| potassium hydroxide (water) | 0.08 |
| triethylamine (water) | 0.07 |
| dibutylamine (ethanol) | 0.08 |
| butylamine (ethanol) | 0.08 |
| cyclohexylamine (ethanol) | 0.08 |
| dicyclohexylamine (ethanol) | 0.08 |
| pyridine (acetone) | 0.07 |
| pyrazine (acetone) | 0.08 |
| piperazine (acetone) | 0.08 |

Example 14

A toner containing a basic compound as shown in Table 14 was prepared as in Example 10, except that used was 72 parts by weight of bisphenol A epoxy resin having an average molecular weight of 5,500 as a binder. The toner thus prepared was put in a cartridge of a copying machine so as to transfer an image onto a paper sheet.

The paper sheet having the image formed thereon was kept in contact with a heat roller heated to 200° C. so as to decolor the image from the paper sheet. The reflection density of the paper sheet having the image decolored therefrom was measured, with the result as shown in Table 14. As shown in Table 14, the reflection density of the paper sheet after decoloration of the image was substantially equal to the initial reflection density, supporting that the image can be decolored satisfactorily from the paper sheet regardless of the kind of the basic compound used. The stability of the decolored state was also found to be satisfactory as in Example 10.

TABLE 14

| Kind of Basic Compound | Reflection Density |
|---|---|
| calcium chloride | 0.08 |
| ammonium hydroxide | 0.08 |
| tetramethyl ammonium hydroxide | 0.09 |
| calcium carbonate | 0.08 |
| ammonium carbonate | 0.09 |
| sodium hydroxide | 0.08 |
| potassium hydroxide | 0.08 |
| triethylamine | 0.08 |
| dibutylamine | 0.08 |
| butylamine | 0.09 |
| cyclohexylamine | 0.09 |
| dicyclohexylamine | 0.08 |
| pyridine | 0.08 |
| pyrazine | 0.08 |
| piperazine | 0.08 |

Example 15

Microcapsules having basic compounds shown in Table 15 sealed therein were prepared as in Example 11. Also, prepared was a toner containing the microcapsules as in Example 11, except that used in Example 15 was 67 parts by weight of a bisphenol A epoxy resin having an average molecular weight of 5,500 as a binder. The toner thus prepared was put in a cartridge of a laser beam printer so as to transfer an image onto a paper sheet.

The paper sheet having the image formed thereon was kept in contact for 30 seconds with a heat roller heated to 200° C. so as to decolor the image from the paper sheet. The reflection density of the paper sheet having the image decolored therefrom was measured, with the result as shown in Table 15. As shown in Table 15, the reflection density of the paper sheet after decoloration of the image was substantially equal to the initial reflection density, supporting:that the image can be decolored satisfactorily from the paper sheet regardless of the kind of the basic compound used. The stability of the decolored state was also found satisfactory as in Example 10.

TABLE 15

| Kind of Basic Compound | Reflection Density |
|---|---|
| triethylamine | 0.08 |
| dibutylamine | 0.08 |
| butylamine | 0.08 |
| cyclohexylamine | 0.08 |
| dicyclohexylamine | 0.08 |
| pyridine | 0.08 |
| pyrazine | 0.08 |
| piperazine | 0.08 |

Example 16

A toner was prepared as in Example 10, except that used were 72 parts by weight of bisphenol A epoxy resin having a molecular weight of 5,500 as a binder and 10 parts by weight of cyclohexylamine as a basic compound. The toner thus prepared was put in a cartridge of a copying machine so as to transfer an image onto a paper sheet.

On the other hand, an organic solvent shown in Table 16 was put in an image decoloring apparatus shown in FIG. 2, followed by bringing the solvent into contact with the paper sheet having the image formed thereon so as to decolor the image and subsequently drying the paper sheet. Table 16 shows the reflection density of the paper sheet having the image decolored therefrom. As shown in Table 16, the reflection density after decoloration of the image was substantially equal to the initial reflection density, supporting that the image was decolored satisfactorily regardless of the kind of the organic solvent used. The stability of the decolored state was also found satisfactory as in Example 10.

TABLE 16

| Kind of Organic Solvent | Reflection Density |
|---|---|
| ethyleneglycol diethyl ether | 0.07 |
| isoamyl butyrate | 0.07 |
| methyl ethyl ketone | 0.07 |
| tetrahydrofuran | 0.07 |
| ethyl propyl ether | 0.08 |
| dioxolane | 0.08 |
| cyclohexanone | 0.07 |
| ethyl lactate | 0.08 |
| γ-butyrolactone | 0.08 |
| methyl alcohol/toluene (mixing ratio 1:1) | 0.07 |
| ethyl alcohol/xylene (mixing ratio 1:2) | 0.07 |
| cyclohexanol/toluene (mixing ratio 1:3) | 0.07 |

TABLE 16-continued

| Kind of Organic Solvent | Reflection Density |
|---|---|
| isopropyl alcohol/ethyl acetate (mixing ratio 1:2) | 0.07 |
| isopropyl alcohol/toluene (mixing ratio 1:1) | 0.08 |
| methyl ethyl ketone/hexane (mixing ratio 1:1) | 0.08 |

Example 17

One part by weight of crystal violet lactone (CVL) as a color former, one part by weight of propyl gallate as a developer, 70 parts by weight of polystyrene having an average molecular weight of 45,000 as a binder, and one part by weight of LR-145 (available from JAPAN CARLIT Inc.) as a charge control agent were mixed and sufficiently kneaded by a kneader. The kneaded mixture was pulverized by a pulverizer so as to obtain a powdery material having an average particle size of 10 $\mu$m. Then, 1% by weight of hydrophobic silica was added to 100% by weight of the resultant powdery material so as to prepare a toner. The toner thus prepared was put in a cartridge of a copying machine so as to transfer an image onto a paper sheet.

On the other hand, a decoloring solution was prepared by dissolving 5% by weight of cholesterol and 5% by weight of D-glucose as decolorizers in an organic solvent shown in Table 17. The decoloring solution thus prepared was put in an image decoloring apparatus shown in FIG. 2 and the paper sheet having the image formed thereon was kept in contact for 30 seconds with the decoloring solution so as to decolor the image from the paper sheet. The reflection density of the paper sheet having the image decolored therefrom was measured, with the result as shown in Table 17. As shown in Table 17, the reflection density of the paper sheet after decoloration of the image was substantially equal to the initial reflection density, supporting that the image can be decolored satisfactorily from the paper sheet regardless of the kind of the basic compound used.

TABLE 17

| Kind of Organic Solvent | Reflection Density |
|---|---|
| ethyleneglycol diethyl ether | 0.07 |
| isoamyl butyrate | 0.07 |
| methyl ethyl ketone | 0.07 |
| tetrahydrofuran | 0.07 |
| ethyl propyl ether | 0.07 |
| dioxolane | 0.08 |
| cyclohexanone | 0.07 |
| ethyl lactate | 0.07 |
| γ-butyrolactone | 0.08 |
| methyl alcohol/toluene (mixing ratio 1:1) | 0.07 |
| ethyl alcohol/xylene (mixing ratio 1:2) | 0.07 |
| cyclohexanol/toluene (mixing ratio 1:3) | 0.07 |
| isopropyl alcohol/ethyl acetate (mixing ratio 1:2) | 0.07 |
| isopropyl alcohol/toluene (mixing ratio 1:1) | 0.08 |
| methyl ethyl ketone/hexane (mixing ratio 1:1) | 0.08 |

The paper sheet having the image decolored therefrom was left to stand at 60° C. for 300 hours, with the result that the image did not appear again on the paper sheet. Then, another image was transferred onto the paper sheet from which the image formed previously was decolored. The image transfer-decoloration process was repeated nine times, followed by transferring a tenth image onto the paper sheet. The quality of the tenth image was found to be substantially equal to that of the first image transferred onto the paper sheet. Further, the copying-decoloring was repeated 50 times, with the result that the copied image and the decolored state were satisfactory in quality after the 50th copying-decoloring operation, though the paper sheet was found to have been physically damaged to some extent.

Example 18

A toner was prepared as in Example 18, except that polystyrene having a molecular weight of 45,000 was added in a mixing ratio as shown in Table 18. The toner thus prepared was put in a cartridge of a laser beam printer so as to transfer an image onto a paper sheet.

On the other hand, a decoloring solution was prepared by dissolving 3% by weight of cholesterol and 3% by weight of D-glucose in ethyleneglycol diethyl ether. The decoloring solution thus prepared was put in an image decoloring apparatus shown in FIG. 1, followed by keeping the decoloring solution in contact for 30 seconds with the paper sheet having the image formed thereon so as to decolor the image and subsequently drying the paper sheet. Table 18 shows the reflection density of the paper sheet having the image decolored therefrom. In the case of using the toner containing 20 to 25% by weight of polystyrene, the image forming material was found to elute out while the paper sheet was kept in contact with the decoloring solution so as to leave marks on the paper sheet. Therefore, the reflection density was not measured in these cases. In the case of using toner containing at least 30% by weight of polystyrene, the reflection density after decoloration of the image was substantially equal to the initial reflection density, supporting that the image was decolored satisfactorily. The stability of the decolored state was also found satisfactory as in Example 17.

TABLE 18

| Polystyrene content of Toner (% by weight) | Reflection Density |
|---|---|
| 20 | — |
| 25 | — |
| 30 | 0.07 |
| 40 | 0.07 |
| 50 | 0.07 |
| 60 | 0.07 |
| 70 | 0.07 |
| 80 | 0.07 |
| 90 | 0.07 |

Example 19

A toner was prepared as in Example 17, except that polystyrene having a different molecular weight was added as a binder in a mixing ratio as shown in Table 19. The toner thus prepared was put in a cartridge of a facsimile so as to transfer an image onto a paper sheet.

On the other hand, a decoloring solution was prepared by dissolving 3% by weight of cholesterol and 3% by weight of D-glucose in ethyleneglycol diethyl ether as dicolorizers. The decoloring solution thus prepared was put in an image decoloring apparatus shown in FIG. 3, followed by spraying the decoloring solution onto the paper sheet having the image formed thereon so as to decolor the image and subsequently drying the paper sheet. Table 19 shows the reflection density of the paper sheet having the image decolored therefrom. As shown in Table 19, it is desirable to diminish the polystyrene content in the case of using a polystyrene having a large molecular weight.

TABLE 19

| Average Molecular Weight of Polystyrene | Polystyrene Content of Toner (% by weight) | Reflection Density |
|---|---|---|
| 45,000 | 40 | 0.07 |
| 45,000 | 85 | 0.07 |
| 45,000 | 90 | 0.08 |
| 220,000 | 40 | 0.07 |
| 220,000 | 75 | 0.07 |
| 220,000 | 85 | 0.08 |
| 630,000 | 40 | 0.07 |
| 630,000 | 70 | 0.07 |
| 630,000 | 80 | 0.08 |
| 630,000 | 90 | 0.42 |

Example 20

A toner was prepared as in Example 17, except that used as a binder was 70 parts by weight of styrene/n-butyl methacrylate copolymer containing 10% by weight of the n-butyl methacrylate and having an average molecular weight of 130,000. The toner thus prepared was put in a cartridge of a copying machine so as to transfer an image onto a paper sheet.

On the other hand, a decoloring solution was prepared by dissolving 3% by weight of cholesterol and 3% by weight of D-glucose in an organic solvent shown in Table 20. The decoloring solution thus prepared was put in a container, followed by keeping the paper sheet having the image formed thereon immersed in the decoloring solution for 30 seconds so as to decolor the image and subsequently drying the paper sheet. Table 20 shows the reflection density of the paper sheet having the image decolored therefrom. As shown in Table 20, the reflection density of the paper sheet after decoloration of the image was substantially equal to the initial reflection density, supporting that the image was decolored satisfactorily. The stability of the decolored state was also found satisfactory as in Example 17.

TABLE 20

| Kind of Organic Solvent | Reflection Density |
|---|---|
| ethyleneglycol diethyl ether | 0.07 |
| isoamyl butyrate | 0.07 |
| methyl ethyl ketone | 0.07 |
| tetrahydrofuran | 0.07 |
| ethyl propyl ether | 0.07 |
| dioxolane | 0.07 |
| cyclohexanone | 0.07 |
| ethyl lactate | 0.07 |
| γ-butyrolactone | 0.08 |
| methyl alcohol/toluene (mixing ratio 1:1) | 0.07 |
| ethyl alcohol/xylene (mixing ratio 1:2) | 0.07 |
| cyclohexanol/toluene (mixing ratio 1:3) | 0.07 |
| isopropyl alcohol/ethyl acetate (mixing ratio 1:2) | 0.07 |

TABLE 20-continued

| Kind of Organic Solvent | Reflection Density |
|---|---|
| isopropyl alcohol/toluene (mixing ratio 1:1) | 0.08 |
| methyl ethyl ketone/hexane (mixing ratio 1:1) | 0.08 |

Example 21

A toner was prepared as in Example 17, except that styrene/n-butyl methacrylate copolymer containing 10% by weight of the n-butyl methacrylate and having a molecular weight of 130,000, was added as a binder in a mixing ratio as shown in Table 21. The toner thus prepared was put in a cartridge of a laser beam printer so as to transfer an image onto a paper sheet.

On the other hand, a decoloring solution was prepared by dissolving 3% by weight of cholesterol and 3% by weight of D-glucose in ethyleneglycol diethyl ether. The decoloring solution thus prepared was put in a container, followed by keeping the decoloring solution in contact for 30 seconds with the paper sheet having the image formed thereon so as to decolor the image and subsequently drying the paper sheet. Table 21 shows the reflection density of the paper sheet having the image decolored therefrom. In the case of using the toner containing 15 to 20% by weight of the binder, the image forming material was found to elute out while the paper sheet was kept in contact with the decoloring solution so as to leave marks on the paper sheet. Therefore, the reflection density was not measured in these cases. In the case of using toner containing at least 30% by weight of polystyrene, the reflection density after decoloration of the image was substantially equal to the initial reflection density, supporting that the image was decolored satisfactorily. The stability of the decolored state was also found satisfactory as in Example 17.

TABLE 21

| Binder content of Toner (% by weight) | Reflection Density |
|---|---|
| 15 | — |
| 20 | — |
| 30 | 0.07 |
| 55 | 0.07 |
| 65 | 0.07 |
| 75 | 0.07 |
| 85 | 0.07 |
| 95 | 0.07 |
| 98 | 0.10 |

Example 22

A toner was prepared as in Example 17, except that styrene/n-butyl methacrylate copolymer containing 10% of the n-butyl methacrylate and having a different molecular weight was added as a binder in a mixing ratio as shown in Table 22. The toner thus prepared was put in a cartridge of a facsimile so as to transfer an image onto a paper sheet.

On the other hand, a decoloring solution was prepared by dissolving 3% by weight of cholesterol and 3% by weight of D-glucose in ethyleneglycol diethyl ether. The decoloring solution thus prepared was put in an image decoloring apparatus shown in FIG. 1, followed by keeping the coloring solution in contact for 30 seconds with the paper sheet having the image formed thereon so as to decolor the image and subsequently drying the paper sheet. Table. 22 shows the reflection density of the paper sheet having the image decolored therefrom. As shown in Table 22, it is desirable to diminish the binder content in the case of using a binder having a large molecular weight.

TABLE 22

| Average Molecular Weight of Binder | Binder Content of Toner (% by weight) | Reflection Density |
|---|---|---|
| 130,000 | 40 | 0.07 |
| 130,000 | 85 | 0.07 |
| 130,000 | 98 | 0.12 |
| 352,000 | 40 | 0.07 |
| 352,000 | 80 | 0.07 |
| 352,000 | 90 | 0.15 |
| 850,000 | 40 | 0.07 |
| 850,000 | 70 | 0.07 |
| 850,000 | 80 | 0.14 |
| 850,000 | 90 | 0.42 |

Example 23

A toner was prepared as in Example 17, except that styrene/n-butyl methacrylate copolymers having an average molecular weight of 130,000 and differing from each other in the n-butyl methacrylate content was added as a binder in amounts as shown in Table 23. The toner thus prepared was put in a cartridge of a copying machine for transferring an image onto a paper sheet.

On the other hand, a decoloring solution was prepared by dissolving 5% by weight of cholesterol and 5% by weight of D-glucose as decolorizers in ethyleneglycol diethyl ether. The decoloring solution thus prepared was put in an image decoloring apparatus shown in FIG. 1. The paper sheet having the image printed thereon was kept immersed in the solvent for 30 seconds so as to decolor the image, followed by drying the paper sheet. Table 23 shows the reflection density of the paper sheet having the image decolored therefrom. As apparent from Table 23, the reflection density of the paper sheet after decoloration of the image was substantially equal to the initial reflection density, supporting that the image was decolored satisfactorily regardless of the kind of the binder contained in the toner. The stability of the decolored state was also found satisfactory as in Example 17.

TABLE 23

| n-butyl methacrylate/ styrene (% by weight) | Binder Content of Toner (% by weight) | Reflection Density |
|---|---|---|
| 5 | 85 | 0.07 |
| 10 | 85 | 0.07 |
| 15 | 85 | 0.07 |
| 20 | 85 | 0.07 |
| 25 | 85 | 0.07 |
| 30 | 90 | 0.07 |
| 35 | 90 | 0.07 |
| 40 | 90 | 0.07 |
| 45 | 80 | 0.08 |
| 50 | 80 | 0.08 |

Example 24

A toner was prepared as in Example 17, except that the binder used consisted of 70 parts by weight of a styrene/acrylic copolymers containing 10% by weight of acrylate monomer shown in Table 24 and having an average molecular weight of 130,000. The toner thus prepared was put in a cartridge of a copying machine for transferring an image onto a paper sheet.

On the other hand, a decoloring solution was prepared by dissolving 7% by weight of cholesterol and 7% by weight of D-glucose as decolorizers in ethyleneglycol diethyl ether. The decoloring solution thus prepared was put in an image decoloring apparatus as shown in FIG. 3. Then, the decoloring solution was sprayed onto the paper sheet having the image formed thereon so as to decolor the image, followed by drying the paper sheet. Table 24 shows the reflection density of the paper sheet having the image decolored therefrom. As apparent from Table 24, the reflection density of the paper sheet after decoloration of the image was substantially equal to the initial reflection density, supporting that the image was decolored satisfactorily regardless of the kind of the binder contained in the toner. The stability of the decolored state was also found to be substantially equal to that in Example 17.

TABLE 24

| Kind of Acrylate Monomer | Reflection Density |
|---|---|
| n-butyl methacrylate | 0.07 |
| isobutyl methacrylate | 0.07 |
| ethyl acrylate | 0.07 |
| n-butyl acrylate | 0.07 |
| glycidyl methacrylate | 0.07 |
| diethylaminopropyl acrylate | 0.07 |
| 2-ethylhexyl acrylate | 0.07 |
| ethyleneglycol methacrylate | 0.07 |
| methyl methacrylate | 0.07 |
| dimethylaminoethyl methacrylate | 0.08 |

Example 25

A toner was prepared as in Example 17, except that the binder used consisted of 70 parts by weight of a blend polymer between polystyrene and 10% by weight of polyacrylate and having an average molecular weight of 130,000 as shown in Table 25. The toner thus prepared was put in a cartridge of a copying machine for transferring an image onto a paper sheet.

On the other hand, a decoloring solution was prepared by dissolving 7% by weight of cholesterol and 7% by weight of D-glucose as decolorizers in ethyleneglycol diethyl ether. The decoloring solution thus prepared was put in a container. The paper sheet having the image formed thereon was immersed in the decoloring solution so as to decolor the image, followed by drying the paper sheet. Table 25 shows the reflection density of the paper sheet having the image decolored therefrom. As apparent from Table 25, the reflection density of the paper sheet after decoloration of the image was substantially equal to the initial reflection density, supporting that the image was decolored satisfactorily regardless of the kind of the binder contained in the toner. The stability of the decolored state was also found to be substantially equal to that in Example 17.

TABLE 25

| Kind of Polyacrylate | Reflection Density |
|---|---|
| poly(n-butyl methacrylate) | 0.07 |
| poly(isobutyl methacrylate) | 0.07 |
| poly(ethyl acrylate) | 0.08 |
| poly(n-butyl acrylate) | 0.09 |
| poly(glycidyl methacrylate) | 0.09 |
| poly(diethylaminopropyl acrylate) | 0.09 |
| poly(2-ethylhexyl acrylate) | 0.09 |
| poly(ethyleneglycol methacrylate) | 0.10 |
| poly(methyl methacrylate) | 0.11 |
| poly(dimethylaminoethyl methacrylate) | 0.09 |

Example 26

One part by weight of crystal violet lactone (CVL) as a color former, one part by weight of propyl gallate as a developer, 72 parts by weight of fumaric acid/etherified diphenol-based polyester having an average molecular weight of 11,500 as a binder, one part by weight of a charge control agent, and 5 parts by weight of a basic compound shown in Table 26 were mixed and kneaded with a kneader. The kneaded mixture was pulverized with a pulverizer to obtain a powdery material having an average particle size of 10 $\mu$m. Then, a toner was prepared by adding 1% by weight of hydrophobic silica to 100% by weight of powdery material thus obtained. The resultant toner was put in a cartridge of a laser beam printer so as to transfer an image onto a paper sheet.

On the other hand, a decoloring solution was prepared by dissolving 7% by weight of cholesterol and 7% by weight of D-glucose as dicolorizers in toluene. The decoloring solution thus prepared was put in a container, and the paper sheet having the image formed thereon was kept immersed for 30 seconds in the decoloring solution so as to decolor the image from the paper sheet, followed by drying the paper sheet. Further, the paper sheet having the image formed thereon was kept in contact with a heat roller heated to 200° C. The reflection density of the paper sheet having the image decolored therefrom was measured, with the result as shown in Table 26. As shown in Table 26, the reflection density of the paper sheet after decoloration of the image was substantially equal to the initial reflection density, supporting that the image can be decolored satisfactorily from the paper sheet regardless of the kind of the basic compound used.

TABLE 26

| Kind of Basic Compound | Reflection Density |
|---|---|
| calcium chloride | 0.07 |
| ammonium hydroxide | 0.07 |
| tetramethylammonium hydroxide | 0.07 |
| calcium carbonate | 0.08 |
| ammonium carbonate | 0.08 |
| sodium hydroxide | 0.08 |
| potassium hydroxide | 0.08 |
| triethylamine | 0.07 |
| dibutylamine | 0.08 |
| butylamine | 0.08 |
| cyclohexylamine | 0.08 |
| dicyclohexylamine | 0.08 |
| pyridine | 0.08 |

TABLE 26-continued

| Kind of Basic Compound | Reflection Density |
|---|---|
| pyrazine | 0.08 |
| piperazine | 0.08 |

The paper sheet having the image decolored therefrom was left to stand at 60° C. for 300 hours, with the result that the image did not appear again on the paper sheet. Then, another image was transferred onto the paper sheet from which the image formed previously was decolored. The image transfer-decoloration process was repeated nine times, followed by transferring a tenth image onto the paper sheet. The quality of the tenth image was found to be substantially equal to that of the first image transferred onto the paper sheet. Further, the copying-decoloring was repeated 50 times, with the result that the copied image and the decolored state were satisfactory in quality after the 50th copying-decoloring operation, though the paper sheet was found to have been physically damaged to some extent.

Example 27

Four grams of a basic compound shown in Table 27 were added to a solution (37° C.) prepared by dissolving 4 g of gelatin in 40 mL of water, and then 45 mL of a solution (37° C.) containing 11 g of sodium sulfate was added thereto, thereby coacervation was induced. The resultant dispersion was cooled to 30° C., followed by leaving the cool dispersion to stand so as to separate microcapsules by means of decantation. Then, formaldehyde was added in an amount of 1 mL to 1 mL of the resultant microcapsules while keeping the mixture stirred for 5 minutes, followed by adding 2 mL of ethanol to the mixture while keeping the mixture stirred for 5 minutes and subsequently separating the microcapsules by filtration. The microcapsules thus obtained was washed with a cold water, followed by drying the water-washed microcapsules. In this fashion, prepared were microcapsules having a basic compound sealed therein.

In the next step, one part by weight of crystal violet lactone (CVL) as a color former, one part by weight of propyl gallate as a developer, 67 parts by weight of maleic acid/propyleneglycol-based polyester having an average molecular weight of 11,500 as a binder, one part by weight of a charge control agent, and 10 parts by weight of the microcapsules prepared as described above were mixed and sufficiently kneaded by a kneader. The kneaded mixture was pulverized by a pulverizer so as to obtain a powdery material having an average particle size of 10 $\mu$m. Then, 1% by weight of hydrophobic silica was added to 100% by weight of the resultant powdery material so as to prepare a toner.

The toner thus prepared was put in a cartridge of a copying machine so as to transfer an image onto a paper sheet.

On the other hand, a decoloring solution was prepared by dissolving 7% by weight of cholesterol and 7% by weight of D-glucose as decolorizers in toluene. The decoloring solution thus prepared was put in a container, and the paper sheet having the image formed thereon was kept immersed for 30 seconds in the decoloring solution so as to decolor the image, followed by drying the paper sheet. Further, the paper sheet having the image formed thereon was kept in contact with a heat roller heated to 200° C. The reflection density of the paper sheet having the image decolored therefrom was measured, with the result as shown in Table 27. As shown in Table 27, the reflection density of the paper sheet after decoloration of the image was substantially equal to the initial reflection density, supporting that the image can be decolored satisfactorily from the paper sheet regardless of the kind of the basic compound used.

The stability of the decolored state was also found to be substantially equal to that in Example 26.

TABLE 27

| Kind of Basic Compound | Reflection Density |
|---|---|
| triethylamine | 0.07 |
| dibutylamine | 0.08 |
| butylamine | 0.08 |
| cyclohexylamine | 0.08 |
| dicyclohexylamine | 0.08 |
| pyridine | 0.07 |
| pyrazine | 0.08 |
| piperazine | 0.08 |

Example 28

One part by weight of crystal violet lactone (CVL) as a color former, one part by weight of propyl gallate as a developer, 72 parts by weight of fumaric acid/etherified diphenol-based polyester having an average molecular weight of 11,500 as a binder, one part by weight of a charge control agent, and five parts by weight of calcium chloride were mixed and sufficiently kneaded by a kneader. The kneaded mixture was pulverized by a pulverizer so as to obtain a powdery material having an average particle size of 10 $\mu$m. Then, 1% by weight of hydrophobic silica was added to 100% by weight of the resultant powdery material so as to prepare a toner. The toner thus prepared was put in a cartridge of a laser beam printer so as to transfer an image onto a paper sheet.

On the other hand, a decoloring solution was prepared by dissolving 7% by weight of cholesterol and 7% by weight of D-glucose as decolorizers in an organic solvent shown in Table 28. The decoloring solution thus prepared was put in an image decoloring apparatus shown in FIG. 2, and the paper sheet having the image formed thereon was kept in contact for 30 seconds with the decoloring solution so as to decolor the image, followed by drying the paper sheet. The reflection density of the paper sheet having the image decolored therefrom was measured, with the result as shown in Table 28. As shown in Table 28, the reflection density of the paper sheet after decoloration of the image was substantially equal to the initial reflection density, supporting that the image can be decolored satisfactorily from the paper sheet regardless of the kind of the decoloring solution used. The stability of the decolored state was also found to be substantially equal to that in Example 26.

TABLE 28

| Kind of Organic Solvent | Reflection Density |
|---|---|
| ethyleneglycol diethyl ether | 0.07 |
| isoamyl butyrate | 0.07 |
| methyl ethyl ketone | 0.07 |
| tetrahydrofuran | 0.07 |
| ethyl propyl ether | 0.07 |
| dioxolane | 0.08 |
| cyclohexanone | 0.07 |
| ethyl lactate | 0.07 |

TABLE 28-continued

| Kind of Organic Solvent | Reflection Density |
|---|---|
| γ-butyrolactone | 0.08 |
| methyl alcohol/toluene (mixing ratio 1:1) | 0.07 |
| ethyl alcohol/xylene (mixing ratio 1:2) | 0.07 |
| cyclohexanol/toluene (mixing ratio 1:3) | 0.07 |
| isopropyl alcohol/ethyl acetate (mixing ration 1:2) | 0.07 |
| isopropyl alcohol/toluene (mixing ratio 1:1) | 0.08 |
| methyl ethyl ketone/hexane (mixing ratio 1:1) | 0.08 |

Example 29

One part by weight of ODB-2 (available from Yamamoto Kasei K.K.) as a color former, one part by weight of 2,4,4'-trihydroxybenzophenone as a developer, 3 parts by weight of pyromellitic acid/ethylene glycol-based polyester having a molecular weight of 2,500 as a binder, and 15 parts by weight of paraffin were mixed and sufficiently kneaded using a kneader. Then, a PET sheet 4.5 $\mu$m thick was coated with the kneaded mixture in a thickness of about 2 $\mu$m using a hot melt coater so as to prepare a thermal transfer sheet. The thermal transfer sheet thus prepared was disposed on a paper sheet to form a laminate structure, and the resultant laminate structure was set in a thermal printer so as to print an image onto the paper sheet.

On the other hand, prepared was a solution containing 3% by weight of a basic compound shown in Table 29. The solvent used for preparation of the solution was selected from the group consisting of water, ethanol and acetone depending on the kind of the basic compound, as shown in Table 29. Further, a decoloring solution was prepared by dissolving 3% by weight of 1,2:5,6-diisopropylidene-D-mannitol and 3% by weight of D-fructose as dicolorizers in toluene.

The solution of the basic compound and the decoloring solution were put in two different containers. The paper sheet having the image printed thereon was kept immersed for one minute in the solution of the basic compound, followed by drying the paper sheet and subsequently keeping the paper sheet immersed for 30 seconds in the decoloring solution so as to decolor the printed image. Further, a hot air of 200° C. was kept blown for 30 seconds against the paper sheet. Table 29 also shows the reflection density of the paper sheet having the image decolored therefrom. As shown in Table 29, the reflection density of the paper sheet after decoloration of the image was substantially equal to the initial reflection density, indicating that the image was decolored satisfactorily in any of the case s tested. The stability of the decolored state was also found to be satisfactory as in Example 26.

TABLE 29

| Kind of Basic Compound (Solvent) | Reflection Density |
|---|---|
| calcium chloride (water) | 0.07 |
| ammonium hydroxide (water) | 0.08 |
| tetramethylammonium hydroxide | |

TABLE 29-continued

| Kind of Basic Compound (Solvent) | Reflection Density |
|---|---|
| (water) | 0.07 |
| calcium carbonate (water) | 0.07 |
| ammmonium carbonate (water) | 0.07 |
| sodium hydroxide (water) | 0.07 |
| potassium hydroxide (water) | 0.08 |
| triethylamine (water) | 0.07 |
| dibutylamine (ethanol) | 0.08 |
| butylamine (ethanol) | 0.08 |
| cyclohexylamine (ethanol) | 0.07 |
| dicyclohexylamine (ethanol) | 0.08 |
| pyridine (acetone) | 0.07 |
| pyrazine (acetone) | 0.08 |
| piperazine (acetone) | 0.08 |

Example 30

The thermal transfer sheet prepared in Example 29 was superposed on a paper sheet to form a laminate structure, followed by setting the resultant laminate structure in a thermal printer so as to print an image on the paper sheet.

On the other hand, a decoloring solution was prepared by dissolving 3% by weight of pyridine as a basic compound, 3% by weight of 1,2:5,6-diisopropylidene-D-mannitol and 3% by weight of D-glucose as decolorizers in toluene. The decoloring solution thus prepared was put in a container, and the paper sheet having the image formed thereon was kept immersed in the decoloring solution for 30 seconds so as to decolor the image, followed by blowing a hot air of 200° C. against the paper sheet. The reflection density of the paper sheet having the image decolored therefrom was found to be 0.081. The stability of the decolored state was also found to be substantially equal to that in Example 26.

Example 31

One part by weight of crystal violet lactone (CVL) as a color former, one part by weight of propyl gallate as a developer, 72 parts by weight of fumaric acid/etherified diphenol-based polyester having an average molecular weight of 11,500 as a binder, and one part by weight of a charge control agent were mixed and kneaded with a kneader. The kneaded mixture was pulverized with a pulverizer to obtain a powdery material having an average particle size of 10 $\mu$m. Then, a toner was prepared by adding 1% by weight of hydrophobic silica to 100% by weight of powdery material thus obtained. The resultant toner was put in a cartridge of a copying machine so as to transfer an image onto a paper sheet.

On the other hand, a decoloring solution was prepared by dissolving 3% by weight of pyridine as a basic compound, 3% by weight of 1,2:5,6-diisopropylidene-D-mannitol and 3% by weight of D-glucose as decolorizers in ethyleneglycol diethyl ether. The decoloring solution thus prepared was put in a container, and the paper sheet having the image formed thereon was kept immersed for 30 seconds in the decoloring solution so as to decolor the image from the paper sheet, followed by drying the paper sheet. The reflection density of the paper sheet having the image decolored therefrom was found to be 0.08. The stability of the decolored state was also found to be satisfactory as in Example 26.

Example 32

A toner containing a basic compound shown in Table 30 was prepared as in Example 26, except that 72 parts by weight of bisphenol A epoxy resin having an average molecular weight of 5,500 was used as a binder. The toner thus prepared was put in a cartridge of a copying machine so as to transfer an image onto a paper sheet.

On the other hand, a decoloring solution was prepared by dissolving 7% by weight of cholesterol and 7% by weight of D-glucose as decolorizers in toluene. The decoloring solution thus prepared was put in a container, and the paper sheet having the image formed thereon was kept immersed for 30 seconds in the decoloring solution so as to decolor the image from the paper sheet, followed by drying the paper sheet. Further, the paper sheet having the image formed thereon was kept in contact with for 30 seconds a heat roller heated to 200° C. The reflection density of the paper sheet having the image decolored therefrom was measured, with the result as shown in Table 30. As shown in Table 30, the reflection density of the paper sheet after decoloration of the image was found to be substantially equal to the initial reflection density, supporting that the picture was decolored satisfactorily regardless of the kind of the basic compound used. The stability of the decolored state was also found to be satisfactory as in Example 26.

TABLE 30

| Kind of Basic Compound | Reflection Density |
|---|---|
| calcium chloride | 0.07 |
| ammonium hydroxide | 0.07 |
| tetramethylammonium hydroxide | 0.08 |
| calcium carbonate | 0.08 |
| ammonium carbonate | 0.09 |
| sodium hydroxide | 0.08 |
| potassium hydroxide | 0.08 |
| triethylamine | 0.08 |
| dibutylamine | 0.08 |
| butylamine | 0.09 |
| cyclohexylamine | 0.09 |
| dicyclohexylamine | 0.08 |
| pyridine | 0.07 |
| pyrazine | 0.08 |
| piperazine | 0.08 |

Example 33

Microcapsules having basic compounds shown in Table 31 were prepared as in Example 27. Also, a toner containing the microcapsules was prepared as in Example 27, except that 67 parts by weight of bisphenol A epoxy resin having an average molecular weight of 5,500 was used as a binder. The toner thus prepared was put in a cartridge of a laser beam printer so as to transfer an image onto a paper sheet.

On the other hand, a decoloring solution was prepared by dissolving 7% by weight of cholesterol and 7% by weight of D-glucose as decolorizers in toluene. The decoloring solution thus prepared was put in a container, and the paper sheet having the image formed thereon was kept immersed for 30 seconds in the decoloring solution so as to decolor the image from the paper sheet, followed by drying the paper sheet. Further, the paper sheet having the image formed thereon was kept in contact for 30 seconds with a heat roller heated to 200° C. The reflection density of the paper sheet having the image decolored therefrom was measured, with the result as shown in Table 31. As shown in Table 31, the reflection density of the paper sheet after decoloration of the image was found to be substantially equal to the initial reflection density, supporting that the picture was decolored satisfactorily regardless of the kind of the basic compound used. The stability of the decolored state was also found to be satisfactory as in Example 26.

TABLE 31

| Kind of Basic Compound | Reflection Density |
|---|---|
| triethylamine | 0.07 |
| dibutylamine | 0.07 |
| butylamine | 0.08 |
| cyclohexylamine | 0.08 |
| dicyclohexylamine | 0.08 |
| pyridine | 0.07 |
| pyrazine | 0.08 |
| piperazine | 0.08 |

Example 34

One part by weight of crystal violet lactone (CVL) as a color former, one part by weight of propyl gallate as a developer, 72 parts by weight of bisphenol A epoxy resin having an average molecular weight of 5,500 as a binder, one part by weight of a charge control agent, and five parts by weight of pyridine as a basic compound were mixed and kneaded with a kneader. The kneaded mixture was pulverized with a pulverizer to obtain a powdery material having an average particle size of 10 $\mu$m. Then, a toner was prepared by adding 1% by weight of hydrophobic silica to 100% by weight of powdery material thus obtained. The resultant toner was put in a cartridge of a copying machine so as to transfer an image onto a paper sheet.

On the other hand, a decoloring solution was prepared by dissolving 5% by weight of cholesterol and 5% by weight of D-glucose as decolorizers in an organic solvent shown in Table 32. The decoloring solution thus prepared was put in an image decoloring apparatus shown in FIG. 1, and the decoloring solution was kept in contact for 30 seconds with the paper sheet having the image formed thereon so as to decolor the image from the paper sheet, followed by drying the paper sheet. The reflection density of the paper sheet having the image decolored therefrom was measured, with the results as shown in Table 32. As shown in Table 32, the reflection density of the paper sheet after decoloration of the image was found to be substantially equal to the initial reflection density, supporting that the image was decolored satisfactorily regardless of the kind of the decoloring solution used. The stability of the decolored state was also found to be satisfactory as in Example 26.

TABLE 32

| Kind of Organic Solvent | Reflection Density |
|---|---|
| ethyleneglycol diethyl ether | 0.07 |
| isoamyl butyrate | 0.07 |
| methyl ethyl ketone | 0.07 |
| tetrahydrofuran | 0.07 |
| ethyl propyl ether | 0.07 |
| dioxolane | 0.08 |
| cyclohexanone | 0.07 |
| ethyl lactate | 0.07 |
| γ-butyrolactone | 0.08 |
| methyl alcohol/toluene (mixing ratio 1:1) | 0.07 |
| ethyl alcohol/xylene (mixing ratio 1:2) | 0.07 |
| cyclohexanol/toluene (mixing ratio 1:3) | 0.07 |

TABLE 32-continued

| Kind of Organic Solvent | Reflection Density |
|---|---|
| isopropyl alcohol/ethyl acetate (mixing ratio 1:2) | 0.07 |
| isopropyl alcohol/toluene (mixing ratio 1:1) | 0.08 |
| methyl ethyl ketone/hexane (mixing ratio 1:1) | 0.08 |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of decoloring an image formed on a paper sheet by using an image forming material containing a color former, a developer and a decolorizer, comprising the steps of:

bringing a solvent into contact with said image forming material for decoloring said image; and removing a residual solvent from said paper sheet.

2. The method according to claim 1, wherein said image forming material is brought into contact with a solvent, followed by heating the image forming material.

3. The method according to claim 1, wherein said decolorizer comprising a highly amorphous phase separation inhibitor and a slightly amorphous phase separation inhibitor.

4. The method according to claim 3, wherein said highly amorphous phase separation inhibitor consists of a cyclic sugar alcohol, and said slightly amorphous phase separation inhibitor consists of a non-aromatic cyclic compound having a five-membered or larger ring substituted by a hydroxyl group or a derivative of a cyclic sugar alcohol.

5. The method according to claim 3, wherein said slightly amorphous phase separation inhibitor is a terpene alcohol.

6. The method according to claim 3, wherein said highly amorphous phase separation inhibitor is contained in said image forming material, and said slightly amorphous phase separation inhibitor is contained in said solvent.

7. The method according to claim 3, wherein said slightly amorphous phase separation inhibitor is contained in said image forming material, and said highly amorphous phase separation inhibitor is contained in said solvent.

8. The method according to claim 1, wherein a binder is contained in said image forming material.

9. The method according to claim 8, wherein said binder is selected from the group consisting of polyester and epoxy resin.

10. The method according to claim 8, wherein said binder is selected from the group consisting of polystyrene, styrene-acrylate copolymer and a blend polymer of polystyrene and an acrylic resin.

11. The method according to claim 10, wherein at least 50% by weight of styrene unit is contained in said binder consisting of styrene-acrylate copolymer or a blend polymer consisting of polystyrene and acrylic resin.

12. The method according to claim 1, wherein said image forming material contains a binder consisting of polyester or epoxy resin and a basic compound.

13. The method according to claim 1, wherein said image forming material contains a microcapsule having a binder consisting of polyester or epoxy resin and a basic compound encapsulated therein.

14. The method according to claim 1, wherein said image forming material contains a binder consisting of polyester or epoxy resin, and said solvent contains a basic compound.

15. A method of decoloring an image formed on a paper sheet by using an image forming material containing a color former and a developer, comprising the steps of:

bringing a solvent containing a decolorizer into contact with said image forming material for decoloring the image, said decolorizer comprising a highly amorphous phase separation inhibitor and a slightly amorphous phase separation inhibitor; and removing a residual solvent from said paper sheet.

16. The method according to claim 15, wherein a binder is contained in said image forming material.

17. The method according to claim 16, wherein said binder is selected from the group consisting of polystyrene, styrene-acrylate copolymer and a blend polymer consisting of polystyrene and an acrylic resin.

18. The method according to claim 17, wherein at least 50% by weight of styrene unit is contained in said binder consisting of styrene-acrylate copolymer or a blend polymer consisting of polystyrene and acrylic resin.

19. The method according to claim 16, wherein said binder consists of a polyester or an epoxy resin.

20. The method according to claim 15, wherein a binder consisting of a polyester or an epoxy resin and a basic compound are contained in said image forming material.

21. The method according to claim 15, wherein said binder consisting of a polyester or an epoxy resin is contained in said image forming material, and a basic compound and a decolorizer are contained in said solvent.

22. The method according to claim 15, wherein said binder consisting of a polyester or an epoxy resin is contained in said image forming material, and a solvent containing a basic compound and another solvent containing a decolorizer are separately brought into contact with said image forming material.

23. The method according to claim 15, wherein said highly amorphous phase separation inhibitor consists of a cyclic sugar alcohol, and said slightly amorphous phase separation inhibitor consists of a non-aromatic cyclic compound having a five-membered or larger ring substituted by a hydroxyl group or a derivative of a cyclic sugar alcohol.

24. The method according to claim 15, wherein said slightly amorphous phase separation inhibitor is a terpene alcohol.

25. The method according to claim 15, wherein said highly amorphous phase separation inhibitor is contained in said image forming material, and said slightly amorphous phase separation inhibitor is contained in said solvent.

26. The method according to claim 15, wherein said slightly amorphous phase separation inhibitor is contained in said image forming material, and said highly amorphous phase separation inhibitor is contained in said solvent.

* * * * *